US011066835B2

(12) United States Patent
Boo

(10) Patent No.: US 11,066,835 B2
(45) Date of Patent: Jul. 20, 2021

(54) BUILDING PANEL WITH A MECHANICAL LOCKING SYSTEM

(71) Applicant: VÄLINGE INNOVATION AB, Viken (SE)

(72) Inventor: Christian Boo, Kagerod (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 16/419,660

(22) Filed: May 22, 2019

(65) Prior Publication Data

US 2019/0271165 A1 Sep. 5, 2019

Related U.S. Application Data

(60) Continuation of application No. 15/365,546, filed on Nov. 30, 2016, now Pat. No. 10,352,049, which is a (Continued)

(30) Foreign Application Priority Data

Jun. 27, 2013 (SE) ..... 1350783-5
Nov. 8, 2013 (SE) ..... 1351323-9

(51) Int. Cl.
*E04F 15/02* (2006.01)
*E04C 2/40* (2006.01)
*E04F 15/10* (2006.01)

(52) U.S. Cl.
CPC ..... *E04F 15/02038* (2013.01); *E04C 2/40* (2013.01); *E04F 15/102* (2013.01); (Continued)

(58) Field of Classification Search
CPC ..... E04F 15/02038; E04F 15/102; E04F 2201/023; E04F 2201/044; (Continued)

(56) References Cited

U.S. PATENT DOCUMENTS 87,853 A 3/1869 Kappes
108,068 A 10/1870 Utley
(Continued)

FOREIGN PATENT DOCUMENTS

CN 201588375 U 9/2010
CN 201110035241.6 1/2011
(Continued)

OTHER PUBLICATIONS

U.S. Appl. No. 16/439,827, Pervan.
(Continued)

*Primary Examiner* — Brent W Herring
(74) *Attorney, Agent, or Firm* — Buchanan Ingersoll & Rooney P.C.

(57) ABSTRACT

A set of essentially identical panels, such as building panels, provided with a mechanical locking system including a displaceable tongue, which is arranged in a displacement groove with a first opening at a first edge of a first panel. The displaceable tongue is configured to cooperate with a first tongue groove, with a second opening at a second edge of an adjacent second panel, for vertical locking of the first and the second edge. The height of the first opening is greater than a second height of the second opening.

20 Claims, 14 Drawing Sheets

Related U.S. Application Data division of application No. 14/315,879, filed on Jun. 26, 2014, now Pat. No. 10,017,949.

(52) U.S. Cl.
CPC . *E04F 2201/0146* (2013.01); *E04F 2201/023* (2013.01); *E04F 2201/044* (2013.01); *E04F 2201/0535* (2013.01); *E04F 2201/0547* (2013.01); *E04F 2201/0552* (2013.01)

(58) Field of Classification Search
CPC ..... E04F 2201/0535; E04F 2201/0552; E04F 2201/0146; E04F 2201/0547; E04C 2/40
USPC .. 52/588.1, 582.1, 578, 586.1, 586.2, 309.1, 52/391, 392; 403/367, 368, 372, 376, 403/334, 345
See application file for complete search history.

(56) References Cited

U.S. PATENT DOCUMENTS 124,228 A 3/1872 Stuart
213,740 A 4/1879 Conner
274,354 A 3/1883 McCarthy et al.
316,176 A 4/1885 Ransom
634,581 A 10/1899 Miller
861,911 A 7/1907 Stewart
1,194,636 A 8/1916 Joy
1,723,306 A 8/1929 Sipe
1,743,492 A 1/1930 Sipe
1,809,393 A 6/1931 Rockwell
1,902,716 A 3/1933 Newton
2,026,511 A 12/1935 Storm
2,027,292 A 1/1936 Rockwell
2,110,728 A 3/1938 Hoggatt
2,142,305 A 1/1939 Davis
2,204,675 A 6/1940 Grunert
2,266,464 A 12/1941 Kraft
2,277,758 A 3/1942 Hawkins
2,430,200 A 11/1947 Wilson
2,596,280 A 5/1952 Nystrom
2,732,706 A 1/1956 Friedman
2,740,167 A 4/1956 Rowley
2,858,584 A 11/1958 Gaines
2,863,185 A 12/1958 Riedi
2,865,058 A 12/1958 Andersson
2,889,016 A 6/1959 Warren
3,023,681 A 3/1962 Worson
3,077,703 A 2/1963 Bergstrom
3,099,110 A 7/1963 Spaight
3,147,522 A 9/1964 Schumm
3,172,237 A 3/1965 Bradley
3,187,612 A 6/1965 Hervey
3,271,787 A 9/1966 Clary
3,276,797 A 10/1966 Humes, Jr.
3,308,588 A 3/1967 Von Wedel
3,325,585 A 6/1967 Brenneman
3,331,180 A 7/1967 Vissing et al.
3,378,958 A 4/1968 Parks et al.
3,396,640 A 8/1968 Fujihara
3,512,324 A 5/1970 Reed
3,517,927 A 6/1970 Kennel
3,526,071 A 9/1970 Watanabe
3,535,844 A 10/1970 Glaros
3,572,224 A 3/1971 Perry
3,579,941 A 5/1971 Tibbals
3,626,822 A 12/1971 Koster
3,640,191 A 2/1972 Hendrich
3,694,983 A 10/1972 Couquet
3,720,027 A 3/1973 Christensen
3,722,379 A 3/1973 Koester
3,731,445 A 5/1973 Hoffmann et al.
3,742,669 A 7/1973 Mansfeld
3,760,547 A 9/1973 Brenneman
3,760,548 A 9/1973 Sauer et al.
3,764,767 A 10/1973 Randolph
3,778,954 A 12/1973 Meserole
3,849,235 A 11/1974 Gwynne
3,919,820 A 11/1975 Green
3,950,915 A 4/1976 Cole
3,994,609 A 11/1976 Puccio
4,007,767 A 2/1977 Colledge
4,007,994 A 2/1977 Brown
4,030,852 A 6/1977 Hein
4,037,377 A 7/1977 Howell et al.
4,041,665 A 8/1977 de Munck
4,064,571 A 12/1977 Phipps
4,080,086 A 3/1978 Watson
4,082,129 A 4/1978 Morelock
4,100,710 A 7/1978 Kowallik
4,104,840 A 8/1978 Heintz et al.
4,107,892 A 8/1978 Bellem
4,113,399 A 9/1978 Hansen, Sr. et al.
4,154,041 A 5/1979 Namy
4,169,688 A 10/1979 Toshio
RE30,154 E 11/1979 Jarvis
4,196,554 A 4/1980 Anderson
4,227,430 A 10/1980 Janssen et al.
4,299,070 A 11/1981 Oltmanns
4,304,083 A 12/1981 Anderson
4,426,820 A 1/1984 Terbrack
4,447,172 A 5/1984 Galbreath
4,512,131 A 4/1985 Laramore
4,599,841 A 7/1986 Haid
4,622,784 A 11/1986 Black
4,648,165 A 3/1987 Whitehorne
4,819,932 A 4/1989 Trotter, Jr.
4,948,716 A 8/1990 Mihayashi et al.
4,998,395 A 3/1991 Bezner
5,007,222 A 4/1991 Raymond
5,026,112 A 6/1991 Rice
5,071,282 A 12/1991 Brown
5,135,597 A 8/1992 Barker
5,148,850 A 9/1992 Urbanick
5,173,012 A 12/1992 Ortwein et al.
5,182,892 A 2/1993 Chase
5,247,773 A 9/1993 Weir
5,272,850 A 12/1993 Mysliwiec et al.
5,274,979 A 1/1994 Tsai
5,281,055 A 1/1994 Neitzke et al.
5,293,728 A 3/1994 Christopher et al.
5,295,341 A 3/1994 Kajiwara
5,344,700 A 9/1994 McGath et al.
5,348,778 A 9/1994 Knipp et al.
5,373,674 A 12/1994 Winter, IV
5,465,546 A 11/1995 Buse
5,485,702 A 1/1996 Sholton
5,502,939 A 4/1996 Zadok et al.
5,548,937 A 8/1996 Shimonohara
5,577,357 A 11/1996 Civelli
5,587,218 A 12/1996 Betz
5,598,682 A 2/1997 Haughian
5,616,389 A 4/1997 Blatz
5,618,602 A 4/1997 Nelson
5,634,309 A 6/1997 Polen
5,658,086 A 8/1997 Brokaw et al.
5,694,730 A 12/1997 Del Rincon et al.
5,755,068 A 5/1998 Ormiston
5,860,267 A 1/1999 Pervan
5,899,038 A 5/1999 Stroppiana
5,910,084 A 6/1999 Koike
5,950,389 A 9/1999 Porter
5,970,675 A 10/1999 Schray
6,006,486 A 12/1999 Moriau
6,029,416 A 2/2000 Andersson
6,052,960 A 4/2000 Yonemura
6,065,262 A 5/2000 Motta
6,098,354 A 8/2000 Skandis
6,122,879 A 9/2000 Montes
6,134,854 A 10/2000 Stanchfield
6,145,261 A 11/2000 Godfrey et al.
6,164,618 A 12/2000 Yonemura
6,173,548 B1 1/2001 Hamar et al.
6,182,410 B1 2/2001 Pervan

(56) References Cited

U.S. PATENT DOCUMENTS 6,203,653 B1 3/2001 Seidner
6,210,512 B1 4/2001 Jones
6,254,301 B1 7/2001 Hatch
6,295,779 B1 10/2001 Canfield
6,314,701 B1 11/2001 Meyerson
6,324,796 B1 12/2001 Heath
6,324,809 B1 12/2001 Nelson
6,332,733 B1 12/2001 Hamberger
6,339,908 B1 1/2002 Chuang
6,345,481 B1 2/2002 Nelson
6,358,352 B1 3/2002 Schmidt
6,363,677 B1 4/2002 Chen et al.
6,385,936 B1 5/2002 Schneider
6,418,683 B1 7/2002 Martensson et al.
6,446,413 B1 9/2002 Gruber
6,449,918 B1 9/2002 Nelson
6,450,235 B1 9/2002 Lee
6,490,836 B1 12/2002 Moriau et al.
6,505,452 B1 1/2003 Hannig
6,546,691 B2 4/2003 Leopolder
6,553,724 B1 4/2003 Bigler
6,576,079 B1 6/2003 Kai
6,584,747 B2 7/2003 Kettler et al.
6,588,166 B2 7/2003 Martensson
6,591,568 B1 7/2003 Pålsson
6,601,359 B2 8/2003 Olofsson
6,617,009 B1 9/2003 Chen et al.
6,647,689 B2 11/2003 Pletzer et al.
6,647,690 B1 11/2003 Martensson
6,651,400 B1 11/2003 Murphy
6,670,019 B2 12/2003 Andersson
6,672,030 B2 1/2004 Schulte
6,681,820 B2 1/2004 Olofsson
6,682,254 B1 1/2004 Olofsson et al.
6,684,592 B2 2/2004 Martin
6,685,391 B1 2/2004 Gideon
6,729,091 B1 5/2004 Martensson
6,763,643 B1 7/2004 Martensson
6,766,622 B1 7/2004 Thiers
6,769,219 B2 8/2004 Schwitte et al.
6,769,835 B2 8/2004 Stridsman
6,802,166 B1 10/2004 Gerhard
6,804,926 B1 10/2004 Eisermann
6,808,777 B2 10/2004 Andersson et al.
6,854,235 B2 2/2005 Martensson
6,862,857 B2 3/2005 Tychsen
6,865,855 B2 3/2005 Knauseder
6,874,291 B1 4/2005 Weber
6,880,307 B2 4/2005 Schwitte et al.
6,948,716 B2 9/2005 Drouin
7,021,019 B2 4/2006 Knauseder
7,040,068 B2 5/2006 Moriau et al.
7,051,486 B2 5/2006 Pervan
7,108,031 B1 9/2006 Secrest
7,121,058 B2 10/2006 Pålsson
7,152,383 B1 12/2006 Wilkinson et al.
7,156,383 B1 1/2007 Jacobs
7,188,456 B2 3/2007 Knauseder
7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,380,383 B2 6/2008 Olofsson et al.
7,441,384 B2 10/2008 Miller et al.
7,451,578 B2 11/2008 Hannig
7,454,875 B2 11/2008 Pervan et al.
7,516,588 B2 4/2009 Pervan
7,517,427 B2 4/2009 Sjoberg et al.
7,520,092 B2 4/2009 Showers et al.
7,533,500 B2 5/2009 Morton et al.
7,556,849 B2 7/2009 Thompson et al.
7,568,322 B2 8/2009 Pervan
7,584,583 B2 * 9/2009 Bergelin ..... E04F 15/02 52/588.1
7,591,116 B2 9/2009 Thiers et al.
7,614,197 B2 11/2009 Nelson
7,617,651 B2 11/2009 Grafenauer
7,621,092 B2 11/2009 Groeke et al.
7,621,094 B2 11/2009 Moriau et al.
7,634,884 B2 12/2009 Pervan
7,637,068 B2 12/2009 Pervan
7,644,553 B2 1/2010 Knauseder
7,654,055 B2 2/2010 Ricker
7,677,005 B2 3/2010 Pervan
7,716,889 B2 5/2010 Pervan
7,721,503 B2 5/2010 Pervan et al.
7,726,088 B2 6/2010 Muehlebach
7,748,176 B2 7/2010 Harding et al.
7,757,452 B2 7/2010 Pervan
7,802,411 B2 9/2010 Pervan
7,806,624 B2 10/2010 McLean et al.
7,827,749 B2 11/2010 Groeke et al.
7,841,144 B2 11/2010 Pervan et al.
7,841,145 B2 11/2010 Pervan et al.
7,841,150 B2 11/2010 Pervan
7,849,642 B2 12/2010 Forster et al.
7,856,789 B2 12/2010 Eisermann
7,861,482 B2 1/2011 Pervan et al.
7,866,110 B2 1/2011 Pervan
7,896,571 B1 3/2011 Hannig et al.
7,900,416 B1 3/2011 Yokubison et al.
7,908,815 B2 3/2011 Pervan et al.
7,908,816 B2 3/2011 Grafenauer
7,913,471 B2 3/2011 Pervan
7,930,862 B2 * 4/2011 Bergelin ..... E04F 15/02 52/316
7,954,295 B2 6/2011 Pervan
7,964,133 B2 6/2011 Cappelle
7,980,039 B2 7/2011 Groeke
7,980,041 B2 7/2011 Pervan
8,001,741 B2 8/2011 Duernberger
8,006,458 B1 8/2011 Olofsson et al.
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,191,334 B2 6/2012 Braun
8,220,217 B2 7/2012 Muehlebach
8,234,830 B2 8/2012 Pervan et al.
8,245,478 B2 8/2012 Bergelin
8,281,549 B2 10/2012 Du
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,794 B2 1/2013 Biro et al.
8,359,805 B2 1/2013 Pervan et al.
8,365,499 B2 2/2013 Nilsson et al.
8,375,673 B2 2/2013 Evjen
8,381,476 B2 2/2013 Hannig
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,511,031 B2 8/2013 Bergelin et al.
8,522,505 B2 9/2013 Beach
8,528,289 B2 9/2013 Pervan et al.
8,544,230 B2 10/2013 Pervan
8,544,232 B2 10/2013 Wybo
8,544,233 B2 10/2013 Pålsson
8,544,234 B2 10/2013 Pervan et al.
8,572,922 B2 11/2013 Pervan
8,578,675 B2 11/2013 Palsson et al.
8,590,250 B2 11/2013 Oh
8,596,013 B2 12/2013 Boo
8,615,952 B2 * 12/2013 Engstrom ..... E04F 15/02038 52/582.2
8,621,814 B2 1/2014 Cappelle

(56) References Cited

U.S. PATENT DOCUMENTS 8,627,862 B2 1/2014 Pervan et al.
8,631,623 B2 1/2014 Engström
8,635,829 B2 1/2014 Schulte
8,640,418 B2 2/2014 Paetrow et al.
8,640,424 B2 2/2014 Pervan et al.
8,650,826 B2 2/2014 Pervan et al.
8,677,714 B2 3/2014 Pervan
8,689,512 B2 4/2014 Pervan
8,701,368 B2 * 4/2014 Vermeulen ..... E04F 15/02038 52/586.2
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,806,832 B2 8/2014 Kell
8,833,026 B2 9/2014 Devos et al.
8,844,236 B2 9/2014 Pervan et al.
8,857,126 B2 * 10/2014 Pervan ..... E04F 15/02038 52/582.1
8,869,485 B2 10/2014 Pervan
8,887,468 B2 * 11/2014 Hakansson ..... A47B 47/0075 52/586.1
8,898,988 B2 12/2014 Pervan
8,925,274 B2 1/2015 Pervan et al.
8,938,929 B2 1/2015 Engström
8,959,866 B2 2/2015 Pervan
8,973,331 B2 3/2015 Boo
8,991,055 B2 3/2015 Cappelle
8,997,423 B2 4/2015 Mann
8,997,430 B1 4/2015 Vermeulen et al.
9,027,306 B2 5/2015 Pervan
9,051,738 B2 6/2015 Pervan et al.
9,068,360 B2 6/2015 Pervan
9,080,329 B2 7/2015 Döhring
9,091,077 B2 7/2015 Boo
9,103,126 B2 8/2015 Kell
9,103,128 B2 8/2015 Pomberger
9,151,062 B2 10/2015 Cappelle et al.
9,181,697 B2 11/2015 Masanek, Jr. et al.
9,194,134 B2 11/2015 Nygren et al.
9,206,611 B2 12/2015 Vermeulen et al.
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,290,948 B2 3/2016 Capelle
9,309,679 B2 4/2016 Pervan et al.
9,316,002 B2 4/2016 Boo
9,340,974 B2 5/2016 Pervan et al.
9,347,227 B2 5/2016 Ramachandra et al.
9,347,469 B2 5/2016 Pervan
9,359,774 B2 6/2016 Pervan
9,366,034 B2 6/2016 Meirlaen et al.
9,366,036 B2 6/2016 Pervan
9,371,654 B2 6/2016 Capelle
9,376,821 B2 6/2016 Pervan et al.
9,382,716 B2 7/2016 Pervan et al.
9,388,584 B2 7/2016 Pervan et al.
9,428,919 B2 8/2016 Pervan et al.
9,453,347 B2 9/2016 Pervan et al.
9,458,634 B2 10/2016 Derelov
9,476,202 B2 10/2016 Clancy et al.
9,482,012 B2 11/2016 Nygren et al.
9,540,825 B2 1/2017 Ramachandra
9,540,826 B2 1/2017 Pervan et al.
9,663,940 B2 5/2017 Boo
9,725,912 B2 8/2017 Pervan
9,771,723 B2 9/2017 Pervan
9,777,487 B2 10/2017 Pervan et al.
9,803,374 B2 10/2017 Pervan
9,803,375 B2 10/2017 Pervan
9,822,533 B2 11/2017 Huang
9,856,656 B2 1/2018 Pervan
9,874,027 B2 1/2018 Pervan
9,945,130 B2 4/2018 Nygren et al.
9,951,526 B2 4/2018 Boo et al.
10,000,935 B2 6/2018 Kell
10,006,210 B2 6/2018 Pervan et al.
10,017,948 B2 7/2018 Boo
10,113,319 B2 10/2018 Pervan
10,125,488 B2 11/2018 Boo
10,138,636 B2 11/2018 Pervan
10,161,139 B2 12/2018 Pervan
10,180,005 B2 1/2019 Pervan et al.
10,214,915 B2 2/2019 Pervan et al.
10,214,917 B2 2/2019 Pervan et al.
10,240,348 B2 3/2019 Pervan et al.
10,240,349 B2 3/2019 Pervan et al.
10,246,883 B2 4/2019 Derelöv
10,352,049 B2 7/2019 Boo
10,358,830 B2 7/2019 Pervan
10,378,217 B2 8/2019 Pervan
10,458,125 B2 10/2019 Pervan
10,480,196 B2 11/2019 Boo
10,519,676 B2 12/2019 Pervan
10,526,792 B2 1/2020 Pervan et al.
10,538,922 B2 1/2020 Pervan
10,570,625 B2 2/2020 Pervan
10,640,989 B2 5/2020 Pervan
10,655,339 B2 5/2020 Pervan
10,669,723 B2 6/2020 Pervan et al.
10,724,251 B2 7/2020 Kell
10,731,358 B2 8/2020 Pervan
10,794,065 B2 10/2020 Boo et al.
10,828,798 B2 11/2020 Fransson
10,933,592 B2 3/2021 Blomgren et al.
10,934,721 B2 3/2021 Pervan et al.
10,953,566 B2 3/2021 Fransson et al.
10,968,639 B2 4/2021 Pervan et al.
10,975,577 B2 4/2021 Pervan et al.
10,995,501 B2 5/2021 Pervan
2001/0024707 A1 9/2001 Andersson et al.
2001/0034991 A1 11/2001 Martensson
2001/0045150 A1 11/2001 Owens
2002/0014047 A1 2/2002 Thiers
2002/0031646 A1 3/2002 Chen et al.
2002/0069611 A1 6/2002 Leopolder
2002/0092263 A1 7/2002 Schulte
2002/0095894 A1 7/2002 Pervan
2002/0108343 A1 8/2002 Knauseder
2002/0170258 A1 11/2002 Schwitte et al.
2002/0170259 A1 11/2002 Ferris
2002/0178674 A1 12/2002 Pervan
2002/0178680 A1 12/2002 Martensson
2002/0189190 A1 12/2002 Charmat et al.
2002/0189747 A1 12/2002 Steinwender
2002/0194807 A1 12/2002 Nelson et al.
2003/0009971 A1 1/2003 Palmberg
2003/0024199 A1 2/2003 Pervan et al.
2003/0037504 A1 2/2003 Schwitte et al.
2003/0066588 A1 4/2003 Pålsson
2003/0084636 A1 5/2003 Pervan
2003/0094230 A1 5/2003 Sjoberg
2003/0101674 A1 6/2003 Pervan
2003/0101681 A1 6/2003 Tychsen
2003/0145549 A1 8/2003 Palsson et al.
2003/0180091 A1 9/2003 Stridsman
2003/0188504 A1 10/2003 Ralf
2003/0196405 A1 10/2003 Pervan
2004/0016196 A1 1/2004 Pervan
2004/0031225 A1 2/2004 Fowler
2004/0031227 A1 2/2004 Knauseder
2004/0049999 A1 3/2004 Krieger
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0137180 A1 7/2004 Sjoberg et al.
2004/0139676 A1 7/2004 Knauseder
2004/0139678 A1 7/2004 Pervan
2004/0159066 A1 8/2004 Thiers et al.

(56) References Cited

U.S. PATENT DOCUMENTS

2004/0168392 A1 9/2004 Konzelmann et al.
2004/0177584 A1 9/2004 Pervan
2004/0182033 A1 9/2004 Wernersson
2004/0182036 A1 9/2004 Sjoberg et al.
2004/0200175 A1 10/2004 Weber
2004/0211143 A1 10/2004 Hannig
2004/0238001 A1 12/2004 Risden
2004/0244325 A1 12/2004 Nelson
2004/0250492 A1 12/2004 Becker
2004/0261348 A1 12/2004 Vulin
2005/0003132 A1 1/2005 Blix et al.
2005/0028474 A1 2/2005 Kim
2005/0050827 A1 3/2005 Schitter
2005/0160694 A1 7/2005 Pervan
2005/0166514 A1 8/2005 Pervan
2005/0183370 A1 8/2005 Cripps
2005/0205161 A1 9/2005 Lewark
2005/0210810 A1 9/2005 Pervan
2005/0235593 A1 10/2005 Hecht
2005/0252130 A1 11/2005 Martensson
2005/0252167 A1 11/2005 Van Horne, Jr.
2005/0268570 A2 12/2005 Pervan
2006/0053724 A1 3/2006 Braun et al.
2006/0070333 A1 4/2006 Pervan
2006/0101769 A1 5/2006 Pervan
2006/0156670 A1 7/2006 Knauseder
2006/0174577 A1 8/2006 O'Neil
2006/0179754 A1 8/2006 Yang
2006/0185287 A1 8/2006 Glazer et al.
2006/0236642 A1 10/2006 Pervan
2006/0260254 A1 11/2006 Pervan et al.
2006/0272262 A1 12/2006 Pomberger
2007/0003366 A1 1/2007 Wedberg
2007/0006543 A1* 1/2007 Engstrom ..... E04F 15/02 52/582.1
2007/0011981 A1 1/2007 Eiserman
2007/0022689 A1 2/2007 Thrush et al.
2007/0028547 A1 2/2007 Grafenauer
2007/0065293 A1 3/2007 Hannig
2007/0094969 A1 5/2007 McIntosh et al.
2007/0094985 A1 5/2007 Grafenauer
2007/0108679 A1 5/2007 Grothaus
2007/0113509 A1 5/2007 Zhang
2007/0151189 A1 7/2007 Yang et al.
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000182 A1 1/2008 Pervan
2008/0000185 A1 1/2008 Duernberger
2008/0000186 A1 1/2008 Pervan et al.
2008/0000187 A1 1/2008 Pervan et al.
2008/0005998 A1 1/2008 Pervan
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0053029 A1 3/2008 Ricker
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0184646 A1 8/2008 Alford
2008/0199676 A1 8/2008 B Athelier et al.
2008/0216434 A1 9/2008 Pervan
2008/0216920 A1 9/2008 Pervan
2008/0236088 A1 10/2008 Hannig et al.
2008/0295432 A1 12/2008 Pervan et al.
2008/0295438 A1 12/2008 Knauseder
2008/0302044 A1 12/2008 Johansson
2009/0019806 A1* 1/2009 Muehlebach ..... E04F 15/02 52/588.1
2009/0049787 A1 2/2009 Hannig
2009/0064624 A1 3/2009 Sokol
2009/0100782 A1* 4/2009 Groeke ..... E04F 15/02 52/589.1
2009/0126308 A1 5/2009 Hannig et al.
2009/0133353 A1 5/2009 Pervan et al.
2009/0151290 A1 6/2009 Liu
2009/0173032 A1 7/2009 Prager et al.
2009/0193741 A1 8/2009 Capelle
2009/0193748 A1 8/2009 Boo et al.
2009/0193753 A1 8/2009 Schitter
2009/0217615 A1* 9/2009 Engstrom ..... E04F 15/02 52/588.1
2009/0241460 A1 10/2009 Beaulieu
2009/0249733 A1 10/2009 Moebus
2009/0308014 A1 12/2009 Muehlebach
2010/0018149 A1 1/2010 Thiers
2010/0043333 A1 2/2010 Hannig et al.
2010/0083603 A1 4/2010 Goodwin
2010/0170189 A1 7/2010 Schulte
2010/0173122 A1 7/2010 Susnjara
2010/0218450 A1 9/2010 Braun
2010/0275541 A1 11/2010 Prinz
2010/0281803 A1 11/2010 Cappelle
2010/0293879 A1 11/2010 Pervan et al.
2010/0300029 A1 12/2010 Braun et al.
2010/0300031 A1 12/2010 Pervan et al.
2010/0313510 A1 12/2010 Tang
2010/0319290 A1 12/2010 Pervan
2010/0319291 A1 12/2010 Pervan et al.
2011/0016815 A1 1/2011 Yang
2011/0030303 A1 2/2011 Pervan et al.
2011/0041996 A1 2/2011 Pervan
2011/0047922 A1 3/2011 Fleming, III
2011/0088344 A1 4/2011 Pervan et al.
2011/0088345 A1 4/2011 Pervan
2011/0088346 A1 4/2011 Hannig
2011/0094178 A1 4/2011 Braun
2011/0131916 A1 6/2011 Chen
2011/0138722 A1 6/2011 Hannig
2011/0154763 A1 6/2011 Bergelin et al.
2011/0162312 A1 7/2011 Schulte
2011/0167744 A1 7/2011 Whispell
2011/0167750 A1 7/2011 Pervan
2011/0167751 A1* 7/2011 Engstrom ..... E04F 15/02 52/588.1
2011/0173914 A1* 7/2011 Engstrom ..... E04F 15/02038 52/582.2
2011/0197535 A1 8/2011 Baker et al.
2011/0225921 A1 9/2011 Schulte
2011/0225922 A1 9/2011 Pervan et al.
2011/0247285 A1 10/2011 Wybo et al.
2011/0252733 A1 10/2011 Pervan
2011/0271631 A1 11/2011 Engstrom
2011/0271632 A1* 11/2011 Cappelle ..... E04F 15/02 52/582.2
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0042598 A1 2/2012 Vermeulen et al.
2012/0055112 A1* 3/2012 Engstrom ..... E04F 15/02144 52/582.2
2012/0124932 A1 5/2012 Schulte et al.
2012/0151865 A1 6/2012 Pervan et al.
2012/0174515 A1 7/2012 Pervan
2012/0174519 A1 7/2012 Schulte
2012/0174520 A1 7/2012 Pervan
2012/0174521 A1 7/2012 Schulte et al.
2012/0192521 A1 8/2012 Schulte
2012/0222378 A1 9/2012 Cappelle et al.
2012/0240502 A1 9/2012 Wilson et al.
2012/0279161 A1* 11/2012 Hakansson ..... A47B 47/0075 52/588.1
2012/0304590 A1* 12/2012 Engstrom ..... E04F 15/02038 52/745.21

(56) References Cited

U.S. PATENT DOCUMENTS

2012/0324816 A1 12/2012 Huang
2013/0008117 A1 1/2013 Pervan
2013/0008118 A1 1/2013 Baert et al.
2013/0014463 A1 1/2013 Pervan
2013/0019555 A1 1/2013 Pervan
2013/0025231 A1 1/2013 Vermeulen
2013/0025964 A1 1/2013 Ramachandra et al.
2013/0042562 A1* 2/2013 Pervan ..... E04F 15/02038 52/582.2
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111837 A1 5/2013 Devos et al.
2013/0111845 A1 5/2013 Pervan
2013/0145708 A1 6/2013 Pervan
2013/0152500 A1 6/2013 Engström
2013/0160391 A1 6/2013 Pervan et al.
2013/0167467 A1 7/2013 Vermeulen et al.
2013/0219806 A1 8/2013 Carrubba
2013/0232905 A2 9/2013 Pervan
2013/0239508 A1 9/2013 Pervan et al.
2013/0263454 A1 10/2013 Boo et al.
2013/0263547 A1 10/2013 Boo
2013/0283719 A1 10/2013 Döhring et al.
2013/0305650 A1 11/2013 Liu
2013/0309441 A1 11/2013 Hannig
2013/0318906 A1 12/2013 Pervan et al.
2014/0007539 A1 1/2014 Pervan et al.
2014/0020324 A1 1/2014 Pervan
2014/0026513 A1 1/2014 Bishop
2014/0033633 A1 2/2014 Kell
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Pervan
2014/0109506 A1 4/2014 Pervan et al.
2014/0123586 A1 5/2014 Pervan et al.
2014/0130437 A1 5/2014 Cappelle
2014/0140766 A1 5/2014 Riccobene et al.
2014/0144096 A1 5/2014 Vermeulen et al.
2014/0150369 A1 6/2014 Hannig
2014/0186104 A1* 7/2014 Hamberger ..... E04F 13/0894 403/292
2014/0190112 A1 7/2014 Pervan
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0283466 A1 9/2014 Boo
2014/0290173 A1 10/2014 Hamberger
2014/0305065 A1 10/2014 Pervan
2014/0338177 A1 11/2014 Vermeulen et al.
2014/0366476 A1 12/2014 Pervan
2014/0366477 A1 12/2014 Kell
2014/0373478 A2 12/2014 Pervan et al.
2014/0373480 A1* 12/2014 Pervan ..... E04F 15/02038 52/588.1
2015/0000221 A1 1/2015 Boo
2015/0013260 A1 1/2015 Pervan
2015/0047278 A1 2/2015 Blount
2015/0047284 A1 2/2015 Cappelle
2015/0059281 A1 3/2015 Pervan
2015/0089896 A2 4/2015 Pervan et al.
2015/0113908 A1 4/2015 Ramachandra et al.
2015/0121796 A1 5/2015 Pervan
2015/0152644 A1 6/2015 Boo
2015/0167318 A1 6/2015 Pervan
2015/0176289 A1 6/2015 Hannig
2015/0176619 A1 6/2015 Baker
2015/0211239 A1 7/2015 Pervan
2015/0233125 A1 8/2015 Pervan et al.
2015/0267419 A1 9/2015 Pervan
2015/0300029 A1 10/2015 Pervan
2015/0330088 A1 11/2015 Derelov
2015/0337537 A1 11/2015 Boo
2015/0337542 A1 11/2015 Cappelle et al.
2015/0368910 A1 12/2015 Kell
2016/0032596 A1 2/2016 Nygren et al.
2016/0060879 A1 3/2016 Pervan
2016/0069086 A1 3/2016 Hüllenkremer
2016/0069088 A1 3/2016 Boo et al.
2016/0076260 A1 3/2016 Pervan et al.
2016/0090744 A1 3/2016 Pervan et al.
2016/0153200 A1 6/2016 Pervan
2016/0160502 A1 6/2016 Brousseau
2016/0168866 A1 6/2016 Pervan et al.
2016/0186426 A1 6/2016 Boo
2016/0194884 A1 7/2016 Pervan et al.
2016/0201336 A1 7/2016 Pervan
2016/0237695 A1 8/2016 Pervan
2016/0251859 A1 9/2016 Pervan et al.
2016/0251860 A1 9/2016 Pervan
2016/0281368 A1 9/2016 Pervan et al.
2016/0281370 A1 9/2016 Pervan et al.
2016/0289984 A1 10/2016 Wagner
2016/0326751 A1 11/2016 Pervan
2016/0340913 A1 11/2016 Derelöv
2017/0030088 A1 2/2017 Simoens
2017/0037641 A1 2/2017 Nygren et al.
2017/0067261 A1 3/2017 Hannig et al.
2017/0081860 A1 3/2017 Boo
2017/0089379 A1 3/2017 Pervan
2017/0254096 A1 9/2017 Pervan
2017/0321433 A1 11/2017 Pervan et al.
2017/0328072 A1 11/2017 Hannig
2017/0362834 A1 12/2017 Pervan et al.
2018/0001509 A1 1/2018 Myllykangas et al.
2018/0001510 A1 1/2018 Fransson
2018/0001573 A1 1/2018 Blomgren et al.
2018/0002933 A1 1/2018 Pervan
2018/0016783 A1 1/2018 Boo
2018/0030737 A1 2/2018 Pervan
2018/0030738 A1 2/2018 Pervan
2018/0119431 A1 5/2018 Pervan et al.
2018/0155934 A1 6/2018 D'Hondt et al.
2018/0178406 A1 6/2018 Fransson et al.
2018/0313094 A1 11/2018 Pervan
2018/0362138 A1 12/2018 Gross
2019/0024387 A1 1/2019 Pervan et al.
2019/0048592 A1 2/2019 Boo
2019/0048596 A1 2/2019 Pervan
2019/0063076 A1 2/2019 Boo et al.
2019/0071879 A1 3/2019 Thiers
2019/0093370 A1 3/2019 Pervan et al.
2019/0093371 A1 3/2019 Pervan
2019/0119928 A1 4/2019 Pervan et al.
2019/0127989 A1 5/2019 Kell
2019/0127990 A1 5/2019 Pervan et al.
2019/0169859 A1 6/2019 Pervan et al.
2019/0232473 A1 8/2019 Fransson et al.
2019/0376298 A1 12/2019 Pervan et al.
2019/0394314 A1 12/2019 Pervan et al.
2020/0087927 A1 3/2020 Pervan
2020/0102756 A1 4/2020 Pervan
2020/0109569 A1 4/2020 Pervan
2020/0149289 A1 5/2020 Pervan
2020/0173175 A1 6/2020 Pervan
2020/0224430 A1 7/2020 Ylikangas et al.
2020/0263437 A1 8/2020 Pervan
2020/0284045 A1 9/2020 Kell
2020/0318667 A1 10/2020 Derelöv
2020/0354969 A1 11/2020 Pervan et al.
2021/0016465 A1 1/2021 Fransson
2021/0047840 A1 2/2021 Pervan
2021/0047841 A1 2/2021 Pervan et al.
2021/0071428 A1 3/2021 Pervan
2021/0087831 A1 3/2021 Nilsson et al.

(56) References Cited

U.S. PATENT DOCUMENTS

| | | | |
|---|---|---|---|
| 2021/0087832 | A1 | 3/2021 | Boo |
| 2021/0087833 | A1 | 3/2021 | Ylikangas et al. |
| 2021/0087834 | A1 | 3/2021 | Ylikangas et al. |

FOREIGN PATENT DOCUMENTS

| | | | | |
|---|---|---|---|---|
| DE | 138 992 | C | 7/1901 | |
| DE | 142 293 | C | 7/1902 | |
| DE | 2 159 042 | | 6/1973 | |
| DE | 25 05 489 | A1 | 8/1976 | |
| DE | 33 43 601 | A1 | 8/1976 | |
| DE | 33 43 601 | A1 | 6/1985 | |
| DE | 33 43 601 | C2 | 6/1985 | |
| DE | 39 32 980 | A1 | 11/1991 | |
| DE | 42 15 273 | A1 | 11/1993 | |
| DE | 42 42 530 | A1 | 6/1994 | |
| DE | 196 01 332 | A | 5/1997 | |
| DE | 299 22 649 | U1 | 3/2000 | |
| DE | 200 02 744 | U1 | 8/2000 | |
| DE | 199 40 837 | A1 | 11/2000 | |
| DE | 202 05 774 | U1 | 8/2002 | |
| DE | 10 2004 001 363 | A1 | 8/2005 | |
| DE | 10 2005 002 297 | A1 | 8/2005 | |
| DE | 10 2006 024 184 | A1 | 11/2007 | |
| DE | 10 2007 018 309 | A1 | 8/2008 | |
| DE | 10 2007 016 553 | A1 | 10/2008 | |
| DE | 10 2007 032 885 | A1 | 1/2009 | |
| DE | 10 2007 035 648 | A1 | 1/2009 | |
| DE | 10 2007 049 792 | A1 | 2/2009 | |
| DE | 10 2009 041 297 | A1 | 3/2011 | |
| EP | 0 013 852 | A1 | 8/1980 | |
| EP | 0 871 156 | A2 | 10/1998 | |
| EP | 1 120 515 | A1 | 8/2001 | |
| EP | 1 146 182 | A2 | 10/2001 | |
| EP | 1 251 219 | A | 10/2002 | |
| EP | 1 279 778 | A2 | 1/2003 | |
| EP | 1 350 904 | A2 | 10/2003 | |
| EP | 1 350 904 | A3 | 10/2003 | |
| EP | 1 396 593 | A2 | 3/2004 | |
| EP | 1 420 125 | A2 | 5/2004 | |
| EP | 1 437 457 | A2 | 7/2004 | |
| EP | 1 437 457 | A3 | 7/2004 | |
| EP | 1 640 530 | A2 | 3/2006 | |
| EP | 1 650 375 | A1 | 4/2006 | |
| EP | 1 650 375 | A8 | 4/2006 | |
| EP | 1 980 683 | A2 | 10/2008 | |
| EP | 2 000 610 | A1 | 12/2008 | |
| EP | 2 236 694 | A1 | 10/2010 | |
| EP | 2236694 | A1 * | 10/2010 | ..... E04F 15/02038 |
| EP | 2 270 291 | A1 | 1/2011 | |
| EP | 2 278 091 | A2 | 1/2011 | |
| EP | 2 333 195 | A1 | 6/2011 | |
| EP | 2 388 394 | A2 | 11/2011 | |
| EP | 2 570 564 | A2 | 3/2013 | |
| EP | 2 333 195 | B1 | 7/2014 | |
| EP | 2 734 684 | B1 | 8/2016 | |
| FR | 1138595 | | 6/1957 | |
| FR | 2 256 807 | | 8/1975 | |
| FR | 2 810 060 | A1 | 12/2001 | |
| GB | 240629 | | 10/1925 | |
| GB | 376352 | | 7/1932 | |
| GB | 1171337 | | 11/1969 | |
| GB | 2 051 916 | A | 1/1981 | |
| JP | H03-110258 | A | 5/1991 | |
| JP | H05-018028 | A | 1/1993 | |
| JP | H06-146553 | A | 5/1994 | |
| JP | H06-288017 | A | 10/1994 | |
| JP | H06-306961 | A | 11/1994 | |
| JP | H06-322848 | A | 11/1994 | |
| JP | H07-300979 | A | 11/1995 | |
| JP | 2900115 | B2 | 6/1999 | |
| JP | 2002-047782 | A | 2/2002 | |
| SE | 526 688 | C2 | 5/2005 | |
| WO | WO 94/26999 | A1 | 11/1994 | |
| WO | WO 96/27721 | A1 | 9/1996 | |
| WO | WO 97/47834 | A1 | 12/1997 | |
| WO | WO 98/22677 | A1 | 5/1998 | |
| WO | WO 99/66151 | A1 | 12/1999 | |
| WO | WO 99/66152 | A1 | 12/1999 | |
| WO | WO 00/43281 | A2 | 7/2000 | |
| WO | WO 00/47841 | A1 | 8/2000 | |
| WO | WO 00/55067 | A1 | 9/2000 | |
| WO | WO 01/02670 | A1 | 1/2001 | |
| WO | WO 01/02672 | A1 | 1/2001 | |
| WO | WO 01/07729 | A1 | 2/2001 | |
| WO | WO 01/38657 | A1 | 5/2001 | |
| WO | WO 01/44669 | A2 | 6/2001 | |
| WO | WO 01/44669 | A3 | 6/2001 | |
| WO | WO 01/48332 | A1 | 7/2001 | |
| WO | WO 01/51732 | A1 | 7/2001 | |
| WO | WO 01/51733 | A1 | 7/2001 | |
| WO | WO 01/66877 | A1 | 9/2001 | |
| WO | WO 01/75247 | A1 | 10/2001 | |
| WO | WO 01/77461 | A1 | 10/2001 | |
| WO | WO 02/055809 | A1 | 7/2002 | |
| WO | WO 02/055810 | A1 | 7/2002 | |
| WO | WO 02/081843 | A1 | 10/2002 | |
| WO | WO 02/103135 | A1 | 12/2002 | |
| WO | WO 03/012224 | A1 | 2/2003 | |
| WO | WO 03/016654 | A1 | 2/2003 | |
| WO | WO 03/025307 | A1 | 3/2003 | |
| WO | WO 03/038210 | A1 | 5/2003 | |
| WO | WO 03/044303 | A1 | 5/2003 | |
| WO | WO 03/074814 | A1 | 9/2003 | |
| WO | WO 03/083234 | A1 | 10/2003 | |
| WO | WO 03/087497 | A1 | 10/2003 | |
| WO | WO 03/089736 | A1 | 10/2003 | |
| WO | WO 2004/003314 | A1 | 1/2004 | |
| WO | WO 2004/020764 | A1 | 3/2004 | |
| WO | WO 2004/048716 | A1 | 6/2004 | |
| WO | WO 2004/050780 | A2 | 6/2004 | |
| WO | WO 2004/079128 | A1 | 9/2004 | |
| WO | WO 2004/079130 | A1 | 9/2004 | |
| WO | WO 2004/085765 | A1 | 10/2004 | |
| WO | WO 2005/003488 | A1 | 1/2005 | |
| WO | WO 2005/003489 | A1 | 1/2005 | |
| WO | WO 2005/054599 | A1 | 6/2005 | |
| WO | WO 2006/050928 | A1 | 5/2006 | |
| WO | WO 2006/104436 | A1 | 10/2006 | |
| WO | WO 2006/123988 | A1 | 11/2006 | |
| WO | WO 2006/125646 | A1 | 11/2006 | |
| WO | WO 2007/015669 | A2 | 2/2007 | |
| WO | WO 2007/015669 | A3 | 2/2007 | |
| WO | WO 2007/142589 | A1 | 12/2007 | |
| WO | WO 2008/004960 | A2 | 1/2008 | |
| WO | WO 2008/004960 | A3 | 1/2008 | |
| WO | WO 2008/004960 | A8 | 1/2008 | |
| WO | WO 2008/017281 | A1 | 2/2008 | |
| WO | WO 2008/060232 | A1 | 5/2008 | |
| WO | WO 2009/066153 | A2 | 5/2009 | |
| WO | WO 2009/116926 | A1 | 9/2009 | |
| WO | WO 2010/070472 | A2 | 6/2010 | |
| WO | WO 2010/070472 | A3 | 6/2010 | |
| WO | WO 2010/070605 | A2 | 6/2010 | |
| WO | WO 2010/087752 | A1 | 8/2010 | |
| WO | WO 2011/001326 | A2 | 1/2011 | |
| WO | WO 2011/012104 | A2 | 2/2011 | |
| WO | WO 2011/012104 | A3 | 2/2011 | |
| WO | WO 2011/012105 | A1 | 2/2011 | |
| WO | WO 2011/032540 | A2 | 3/2011 | |
| WO | WO 2011/038709 | A1 | 4/2011 | |
| WO | WO 2011/108812 | A2 | 9/2011 | |
| WO | WO 2011/151758 | A2 | 12/2011 | |
| WO | WO 2011/151758 | A3 | 12/2011 | |
| WO | WO 2012/059093 | A2 | 5/2012 | |
| WO | WO 2013/012386 | A1 | 1/2013 | |
| WO | WO 2014/209213 | A1 | 12/2014 | |
| WO | WO 2015/105449 | A1 | 7/2015 | |

OTHER PUBLICATIONS

U.S. Appl. No. 16/581,990, Pervan.
U.S. Appl. No. 16/692,104, Pervan.

(56) References Cited

OTHER PUBLICATIONS

U.S. Appl. No. 16/713,373, Ylikangas et al.
U.S. Appl. No. 16/781,301, Pervan.
Extended European Search Report issued in EP 19200326.7, dated Jan. 24, 2020, European Patent Office, Munich, DE, 9 pages.
Ylikangas, Roger, et al., U.S. Appl. No. 16/713,373 entitled "Unlocking System for Panels," filed in the U.S. Patent and Trademark Office on Dec. 13, 2019.
Pervan, Darko, U.S. Appl. No. 16/781,301 entitled "Mechanical Locking of Floor Panels," filed in the U.S. Patent and Trademark Office on Feb. 4, 2020.
U.S. Appl. No. 16/861,666, Pervan.
U.S. Appl. No. 16/861,686, Pervan et al.
U.S. Appl. No. 16/908,902, Pervan.
Pervan, Darko, U.S. Appl. No. 16/861,666 entitled "Mechanical Locking System for Panels and Method of Installing Same," filed in the U.S. Patent and Trademark Office on Apr. 29, 2020.
Pervan, Darko, et al., U.S. Appl. No. 16/861,686 entitled "Mechanical Locking of Floor Panels with a Flexible Bristle Tongue," filed in the U.S. Patent and Trademark Office on Apr. 29, 2020.
Pervan, Darko, U.S. Appl. No. 16/908,902 entitled "Mechanical Locking System for Floor Panels," filed in the U.S. Patent and Trademark Office on Jun. 23, 2020.
U.S. Appl. No. 14/503,780, Darko Pervan, filed Oct. 1, 2014, (Cited herein as US Patent Application Publication No. 2015/0013260 A1 of Jan. 15, 2015).
U.S. Appl. No. 14/938,612, Darko Pervan, filed Nov. 11, 2015, (Cited herein as US Patent Application Publication No. 2016/0060879 A1 of Mar. 3, 2016).
U.S. Appl. No. 15/172,926, Darko Pervan and Agne Pålsson, filed Jun. 3, 2016, (Cited herein as US Patent Application Publication No. 2016/0281368 A1 of Sep. 29, 2016).
U.S. Appl. No. 15/603,913, Darko Pervan, filed May 24, 2017, (Cited herein as US Patent Application Publication No. 2017/0254096 A1 of Sep. 7, 2017).
U.S. Appl. No. 15/896,571, Darko Pervan, Niclas Håkansson and Per Nygren, filed Feb. 14, 2018, (Cited herein as US Patent Application Publication No. 2019/0093370 A1 of Mar. 28, 2019).
U.S. Appl. No. 16/143,610, Darko Pervan, filed Sep. 27, 2018, (Cited herein as US Patent Application Publication No. 2019/0024387 A1 of Jan. 24, 2019).
U.S. Appl. No. 16/163,088, Darko Pervan, filed Oct. 17, 2018, (Cited herein as US Patent Application Publication No. 2019/0048596 A1 of Feb. 14, 2019).
U.S. Appl. No. 16/224,951, Darko Pervan and Tony Pervan, filed Dec. 19, 2018, (Cited herein as US Patent Application Publication No. 2019/0119928 A1 of Apr. 25, 2019).
U.S. Appl. No. 16/269,806, Darko Pervan and Tony Pervan, filed Feb. 7, 2019, (Cited herein as US Patent Application Publication No. 2019/0169859 A1 of Jun. 6, 2019).
U.S. Appl. No. 16/439,827, Darko Pervan, filed Jun. 13, 2019.
International Search Report dated Oct. 23, 2014 in PCT/SE2014/050792, 7 pages, ISA/SE, Patent-och registeringsverket, Stockholm, SE.
Extended European Search Report issued in EP 14 817 686.0, dated Jan. 25, 2017, European Patent Office, Munich, DE, 13 pages.
Välinge Innovation AB, Technical Disclosure entitled "Mechanical locking for floor panels with a flexible bristle tongue," IP.com No. IPCOM000145262D, Jan. 12. 2007, IP.com PriorArtDatabase, 57 pages (VA033).
Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.
Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.
Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.
Engstrand, Ola (Contact)/Välinge Innovation AB, Technical Disclosure entitled "VA055 Mechanical locking system for floor panels," IP com No. IPCOM000206454D, Apr. 27, 2011, IP.com Prior Art Database, 25 pages.
Engstrand, Ola (Contact)/Välinge Innovation AB, Technical Disclosure entitled "VA058 Rocker Tongue," IP com No. IPCOM000203832D, Feb. 4, 2011, IP.com Prior Art Database, 22 pages.
Pervan, Darko (Author)/Välinge Flooring Technology, Technical Disclosure entitled "VA066b Glued Tongue," IP com No. IPCOM000210865D, Sep. 13, 2011, IP.com Prior Art Database, 19 pages.
Pervan, Darko (Inventor)/Välinge Flooring Technology AB, Technical Disclosure entitled "VA067 Fold Slide Loc," IP com No. IPCOM000208542D, Jul. 12, 2011, IP.com Prior Art Database, 37 pages.
Pervan, Darko (Author)/Välinge Flooring Technology, Technical Disclosure entitled "VA068 Press Lock VFT," IP com No. IPCOM000208854D, Jul. 20, 2011, IP.com Prior Art Database, 25 pages.
Pervan, Darko (Author), Technical Disclosure entitled "VA069 Combi Tongue," IP com No. IPCOM000210866D, Sep. 13, 2011, IP.com Prior Art Database, 41 pages.
Pervan, Darko (Author), Technical Disclosure entitled "VA070 Strip Part," IP com No. IPCOM000210867D, Sep. 13, 2011, IP.com Prior Art Database, 43 pages.
Pervan, Darko (Author), Technical Disclosure entitled "VA071 Pull Lock," IP com No. IPCOM000210868D, Sep. 13, 2011, IP.com Prior Art Database, 22 pages.
Pervan, Darko (Author), Technical Disclosure entitled "VA073a Zip Loc," IP com No. IPCOM000210869D, Sep. 13, 2011, IP.com Prior Art Database, 36 pages.
LifeTips, "Laminate Flooring Tips," available at (http://flooring.lifetips.com/cat/61734/laminate-flooring-tips/index.html), 2000, 12 pages.
Pervan, Darko, U.S. Appl. No. 16/439,827 entitled "Mechanical Locking of Floor Panels With Vertical Folding," filed in the U.S. Patent and Trademark Office on Jun. 13, 2019.
U.S. Appl. No. 16/861,666, Darko Pervan, filed Apr. 29, 2020.
U.S. Appl. No. 16/861,686, Darko Pervan and Agne Pålsson, filed Apr. 29, 2020.
U.S. Appl. No. 16/908,902, Darko Pervan, filed Jun. 23, 2020.
U.S. Appl. No. 16/581,990, Darko Pervan, filed Sep. 25, 2019.
U.S. Appl. No. 16/692,104, Darko Pervan, filed Nov. 22, 2019.
Pervan, Darko, U.S. Appl. No. 16/581,990 entitled "Mechanical Locking System for Floor Panels," filed in the U.S. Patent and Trademark Office on Sep. 25, 2019.
Pervan, Darko, U.S. Appl. No. 16/692,104 entitled "Mechanical Locking System for Floor Panels," filed in the U.S. Patent and Trademark Office on Nov. 22, 2019.
**Pervan, Darko, et al., U.S. Appl. No. 17/206,702 entitled "Mechanical Locking of Floor Panels with a Flexible Tongue," filed in the U.S. Patent and Trademark Office dated Mar. 19, 2021.
Pervan, Darko, U.S. Appl. No. 17/224,290 entitled "Mechanical Locking System for Floor Panels," filed in the U.S. Patent and Trademark Office dated Apr. 7, 2021.
Pervan, Darko, U.S. Appl. No. 17/314,431 entitled "Mechanical Locking of Floor Panels with Vertical Folding," filed in the U.S. Patent and Trademark Office dated May 7, 2021.

* cited by examiner

FIG. 1A --PRIOR ART--
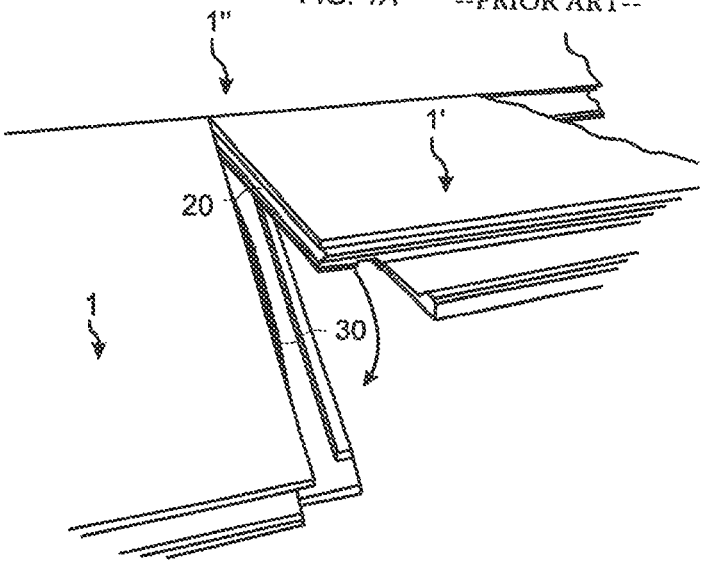
FIG. 1B --PRIOR ART--
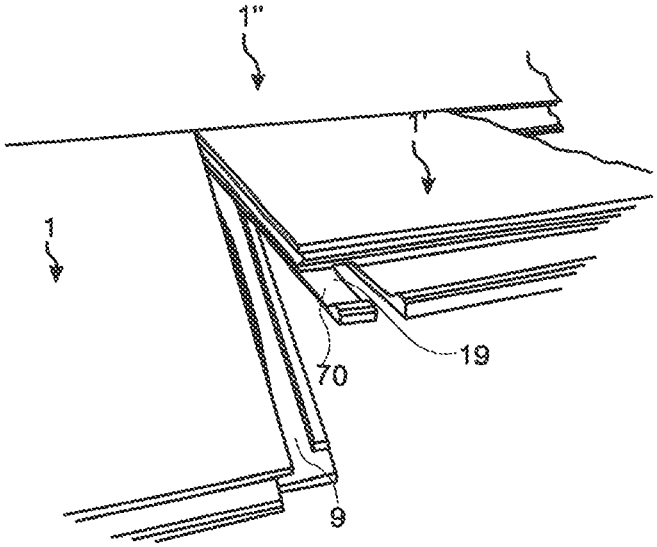

FIG. 2A --PRIOR ART--
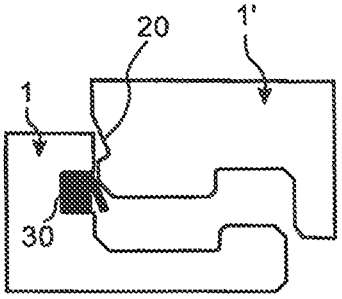
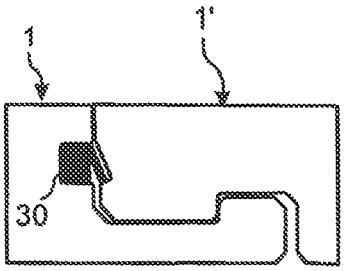
FIG. 2B --PRIOR ART--
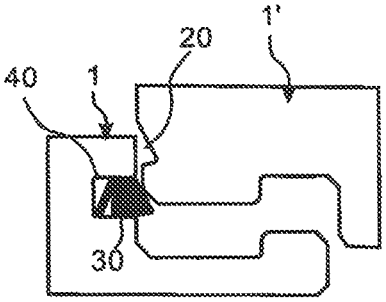
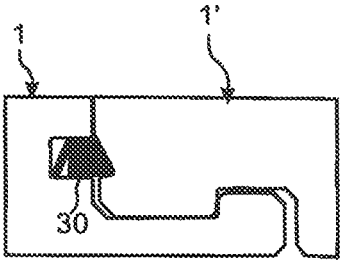
FIG. 2C --PRIOR ART--
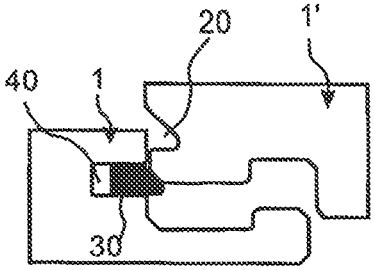
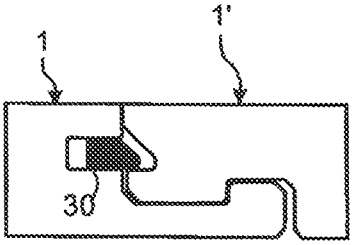

FIG. 3A --PRIOR ART--
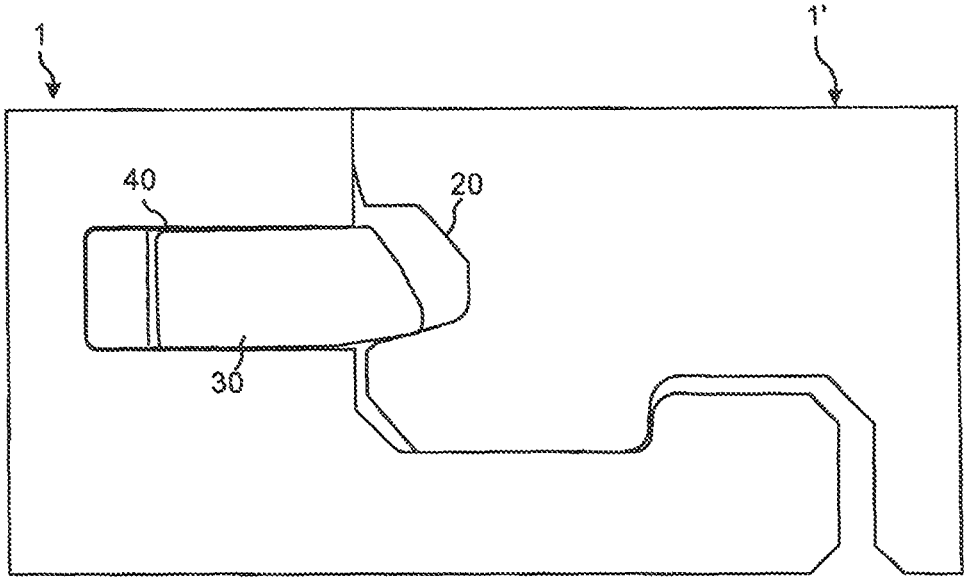
FIG. 3B --PRIOR ART--
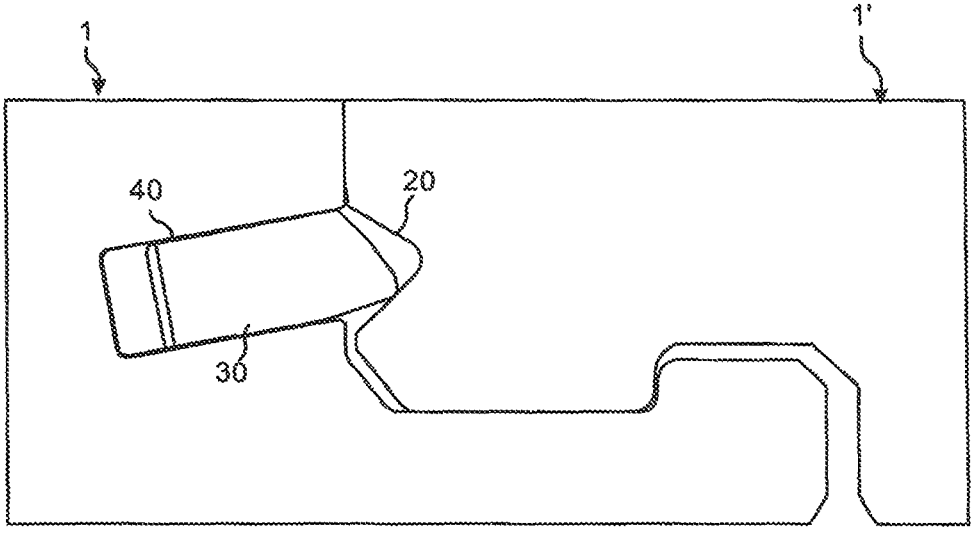

--PRIOR ART--

--PRIOR ART--

BUILDING PANEL WITH A MECHANICAL LOCKING SYSTEM

CROSS REFERENCE TO RELATED APPLICATIONS

The present application is a continuation of U.S. application Ser. No. 15/365,546, filed on Nov. 30, 2016, which is a divisional of U.S. application Ser. No. 14/315,879, filed on Jun. 26, 2014, which claims the benefit of Swedish Application No. 1350783-5, filed on Jun. 27, 2013, and of Swedish Application No. 1351323-9, filed on Nov. 8, 2013. The entire contents of each of U.S. application Ser. No. 15/365,546, U.S. application Ser. No. 14/315,879, Swedish Application No. 1350783-5 and Swedish Application No. 1351323-9 are hereby incorporated herein by reference in their entirety.

TECHNICAL FIELD

The disclosure relates to panels, such as building panels, floorboard, wall panels, ceiling panels, furniture components or the like, which are provided with a mechanical locking system.

TECHNICAL BACKGROUND

Building panels provided with a mechanical locking system comprising a displaceable and resilient tongue cooperating with a tongue groove for vertical locking is known and disclosed in, e.g., WO2006/043893 and WO2007/015669, The tongue is a separate part and is made of, e.g., plastic and inserted in a displacement groove at an edge of a panel. The tongue is pushed into the displacement groove during a vertical assembling of the panels and springs back into the tongue groove of an adjacent panel when the panels have reached a locked position.

Also known is a locking system for panels comprising a tongue, which is displaceable along the edge of a panel, see e.g. WO2009/116926, and cooperates with a tongue groove for vertical locking. The tongue is a separate part and is provided with several protrusions, which initially match recesses of the tongue groove. The panels may be assembled by a vertical movement and the tongue is displaced to a position in which the protrusions no longer match the recesses in order to obtain the vertical locking.

Further known is a locking system comprising a tongue provided with, e.g., a wedge element. Two adjacent panel edges are locked by displacing the tongue along the adjacent edges, see, e.g., WO2008/004960.

Although the description relates to floor panel, the description of techniques and problems thereof is applicable also for other applications, such as panels for other purposes, for example, wall panels, ceiling panels, furniture etc.

A drawback with the known systems is that a locking system comprising a displaceable tongue requires a rather thick panel to ensure that the locking system meets the strength requirement.

The above description of various known aspects is the applicant's characterization of such, and is not an admission that any of the above description is considered as prior art.

SUMMARY

It is an object of certain embodiments of the disclosure to provide an improvement over the above described techniques and known art. Particularly the strength of the known locking system is improved by embodiments of the disclosure.

A further object of embodiments of the disclosure is to provide thinner panels with a locking system comprising a displaceable tongue.

At least some of these and other objects and advantages that will be apparent from the description have been achieved by a first aspect of the disclosure that comprises a set of essentially identical panels provided with a mechanical locking system comprising a displaceable tongue, which is arranged in a displacement groove at a first edge of a first panel and a first tongue groove, at a second edge of an adjacent second panel. The displaceable tongue is configured to cooperate with the first tongue groove for locking in a vertical direction of the first and the second edge. The displacement groove is provided with a first opening and the first tongue groove is provide with a second opening wherein a height of the first opening is greater than a height of the second opening. At least a part of the displaceable tongue is preferably configured to be pushed into the displacement groove during assembling of the first and the second panel and spring back to a position in which an outer part of the displaceable tongue cooperate with the first tongue groove for the locking in the vertical direction.

The height of the second opening may be in the range of about 20% to about 75% of the height of the first opening, preferably in the range of about 20% to about 50% of the height of the first opening.

The first opening and the second opening are preferably horizontally open and a vertical height of the second groove is preferably greater than a vertical height the first opening.

A maximum height of the displacement groove may be greater than a maximum height of the first tongue groove. The maximum height of the first tongue groove may be in the range of about 20% to about 75% of the maximum height of the displacement groove, preferably in the range of about 20% to about 50% of the maximum height of the displacement groove.

An outer part of the displaceable tongue is preferably provided with a recess. The smaller opening of the first tongue groove and the thinner first tongue groove increases the strength of the locking system at the second edge with the first tongue groove. The thicker displacement groove is preferably provided on an edge, i.e., the first edge, with more material available for the displacement groove or a stronger material.

The recess may comprise a first recess surface and a second recess surface, which are arranged at an obtuse angle to each other. The first recess surface of the recess may be a first surface configured to cooperate with the first tongue groove, preferably at a second surface, for locking in the vertical direction. An angle between an upper surface of the displaceable tongue and the first recess surface may be in the range of about 5° to about 15°, preferably in the range of about 7° to about 8°. The recess and the angle may provide the benefit of an increased locking strength, since the first surface and the second surface may be arranged at an angle that requires, in a locked position, an increased force to push the displaceable tongue into the displacement groove.

The displaceable tongue is preferably of a longitudinal shape and an outer longitudinal edge of the displaceable tongue is preferably straight along essentially the whole longitudinal length of the tongue. A bevel may be provide at at least one end of the longitudinal edge, at a short edge of the displaceable tongue, to facilitate assembling of the first and the second panel by an angling movement.

The recess preferably extends along essentially the whole longitudinal length of the displaceable tongue.

The benefits of embodiments of the disclosure may be more pronounced for thin panels, e.g. thinner than 6 mm. The panels may be in the range of about 3 mm to about 10 mm, preferably in the range of about 4 mm to about 8 mm, and preferably in the range of about 4 mm to about 6 mm.

The mechanical locking system may comprise a first locking strip, at the first or the second edge, provided with a first locking element configured to cooperate for horizontal locking with a first locking groove at the other of the first or second edge.

Since the height of the first opening is greater than the second height of the second opening, the first locking strip is preferably arranged at the first edge and the first locking groove on the second edge. An outer and lower part of the displaceable tongue is preferably provided with the recess.

The panels may be rectangular and the mechanical locking system may comprise a second locking strip, at a third or fourth edge, provided with a second locking element configured to cooperate for horizontal locking with a locking groove at the other of the third or fourth edge of an adjacent third panel. The third or the fourth edge is preferably provided with a second tongue configured to cooperate for vertical locking with a second tongue groove at the other of the third or fourth edge of an adjacent third panel. Each edge provided with a locking groove is preferably provided with a lower edge surface configured to cooperate with an upper surface of a locking strip at an adjacent panel. The lower edge surface is therefore preferably arranged in the same plane as the upper surface of the locking strip at the adjacent panel.

An upper surface of the first locking strip is preferably provided in a same plane as an upper surface of the second locking strip. The mechanical locking system at the third and fourth edge is normally produced before the mechanical locking system at the first and second edge. If said upper surfaces are in the same plane or essentially in the same plane remainders of the mechanical locking system at the third and fourth edge, at the corner of the panels may be automatically removed. The remainders are generally thin and may later come loose, e.g. during packaging, transportation or assembling.

The mechanical locking system at the third and the fourth edge may be configured to be assembled by an angling motion.

The mechanical locking system at the first and the second edge may be configured to be assembled by a vertical motion.

A second aspect of the disclosure is a set of essentially identical panels provided with a mechanical locking system comprising a displaceable tongue, which is arranged in a displacement groove at a first edge of a first panel and a first tongue groove at a second edge of a second panel. The displaceable tongue is configured to cooperate with the first tongue groove, for locking in a vertical direction of the first and the second edge. The displaceable tongue comprises at least two bendable parts, wherein at least one of the bendable parts is provided with a lower and/or an upper friction connection at a distance from the innermost part in the displacement groove of the bendable part. The distance may make it easier to arrange the displaceable tongue in the displacement groove. At least a part of the displaceable tongue is preferably configured to be pushed into the displacement groove during assembling of the first and the second panel and spring back to a position in which an outer part of the displaceable tongue cooperate with the first tongue groove for the locking in the vertical direction.

The displacement groove may comprise an upper wall, a lower wall and an inner wall extending between the lower and the upper wall. The inner wall is preferably of a rounded shape or may comprise a plane section provided with a round section adjacent to the upper and/or lower wall. The rounded shape and the round section/s increase the strength of the mechanical locking system. The benefits of this embodiment may be important for thin panels, e.g. thinner than 6 mm. The panels may be in the range of about 3 mm to about 10 mm, and preferably in the range of about 4 mm to about 8 mm.

The upper friction connection is preferably configured to cooperate with a plane section of the upper wall. The upper friction connection may comprise a protruding part of the bendable part that extends above remaining parts of the displaceable tongue. An upper surface of the displaceable tongue may be configured to be displaced along the upper wall during assembling of the first and the second panel. A lower surface of the displaceable tongue may be configured to be displaced along the lower wall during assembling of the first and the second panel.

The lower friction connection is preferably configured to cooperate with a plane section of the lower wall. The lower friction connection may comprise a protruding part of the bendable part that extends below remaining parts of the displaceable tongue.

The innermost part of the bendable part may be provided with an upper and/or lower bevel. The upper and/or lower bevel facilitates the insertion of the displaceable tongue into the displacement groove.

The displaceable tongue may be of a longitudinal shape and an outer longitudinal edge of the displaceable tongue is preferably straight along essentially the whole longitudinal length of the displaceable tongue. A bevel may be provided at at least one end of the longitudinal edge, at a short edge of the displaceable tongue, to facilitate assembling of the first and the second panel by an angling movement.

An outer part of the displaceable tongue may be provided with a recess, which preferably extends along essentially the whole longitudinal length of the tongue. A first surface of the recess is preferably configured to cooperate with a second surface of the first tongue groove for locking in the vertical direction.

The mechanical locking system may comprise a first locking strip, at the first or the second edge, provided with a first locking element configured to cooperate with a first locking groove at the other of the first or second edge for locking in a horizontal direction.

A size of the displacement groove at the first edge may be greater than a size of the first tongue groove at the second edge. The first locking strip is preferably arranged at the first edge and the first locking groove on the second edge. An outer and lower part of the displaceable tongue is preferably provided with the recess.

The displacement groove may have a first opening and the first tongue groove may have a second opening, wherein a first height of the first opening is preferably greater than a second height of the second opening.

The mechanical locking system at the first and the second edge may be configured to be assembled by a vertical motion.

A third aspect of the disclosure is a set of essentially identical panels provided with a mechanical locking system comprising a displaceable tongue, which is arranged in a displacement groove at a first edge of a first panel and a first tongue groove at a second edge of a second panel. The displaceable tongue is configured to cooperate with the first tongue groove, for locking in a vertical direction of the first and the second edge. At least a part of the displaceable tongue is preferably configured to be pushed into the displacement groove during assembling of the first and the second panel and spring back to a position in which a part of the displaceable tongue cooperate with the first tongue groove for the locking in the vertical direction. The displaceable tongue comprises a first and a third surface and the first tongue groove comprises a second and fourth surface. A first angle between the second surface and a front face of the second panel is greater than a second angle between the fourth surface and the front face. The first surface of the displaceable tongue is configured to cooperate with the second surface of the tongue groove under a first load on the mechanical locking system. The third surface of the displaceable tongue is configured to cooperate with the fourth surface of the tongue groove under a second load on the mechanical locking system. The first load may correspond to a load under normal condition and the second load may correspond to an increased load when for example a chair, a sofa or a bookcase is positioned on the first or the second panel. The first angle may have the advantage that a small displacement of the displaceable tongue pushes the first and the second panel together to the desired locked position, in which the front face of the second panel is essentially in the same vertical position as a front face of the first panel. The second angle may have the advantage that the third and the fourth surface are able to carry a greater load and that the displaceable tongue is prevented from being pushed out from the first tongue groove. Another advantage of the second angle is that a height of an opening of the first tongue may be decreased. A decreased height may increase the strength of the mechanical locking system. The first angle may be in the range of about 30° to about 45° and the second angle may be in the range of about 10° to about 25°. The difference between the first angle and the second angle may be in the range of about 10° to about 35°.

The mechanical locking system described under the first and the second aspect may comprise the first, the second, the third and the fourth surface described under the third aspect.

The mechanical locking system at the first and the second edge may be configured to be assembled by a vertical motion.

The panels according to the first, the second or the third aspect may be floorboards, wall panels, ceiling panels, a furniture component or the like.

A core of the panels according to the first, the second or the third aspect may be a wood-based core, preferably made of MDF, HDF, OSB, WPC, plywood or particleboard. The core may also be a plastic core comprising thermosetting plastic or thermoplastic e.g. vinyl, PVC, PU or PET. The plastic core may comprise fillers. The thinner first tongue groove may be easier, for a panel with a layered core, such as a core comprising plywood, to arrange at a favorable position in relation to the layers is the core.

The front face of the panels according to the first, the second or the third aspect is preferably provided with a decorative layer and the back face is preferably provided with a balancing layer.

The edge of the panels, according to the first, the second or the third aspect, of which parts of the locking system, such as the first and the second locking strip, the first and the second locking element, the first and the second locking groove and the first and the second tongue groove, may be made, may comprise the core material.

BRIEF DESCRIPTION OF THE DRAWINGS

The disclosure will by way of example be described in more detail with reference to the appended schematic drawings, which shows embodiments of the disclosure.

FIGS. 1A-1B shows a known locking system with a displaceable tongue.

FIGS. 2A-2C show cross sections of known locking systems with a separate and displaceable tongue.

FIGS. 3A-3B show cross sections of known locking system with a separate and displaceable tongue.

DETAILED DESCRIPTION

Figure 4A:
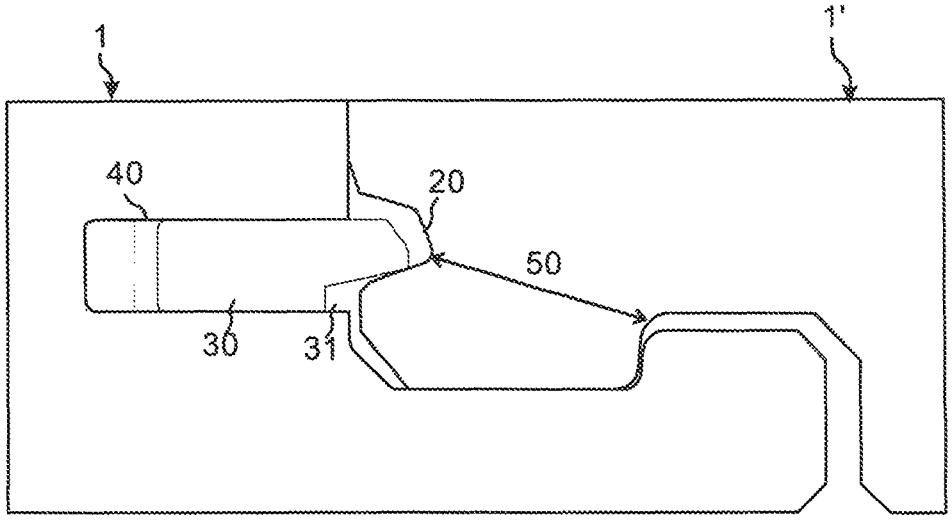
FIGS. 4A-4B show cross sections of panels according to embodiments of the disclosure.
Figure 4B:
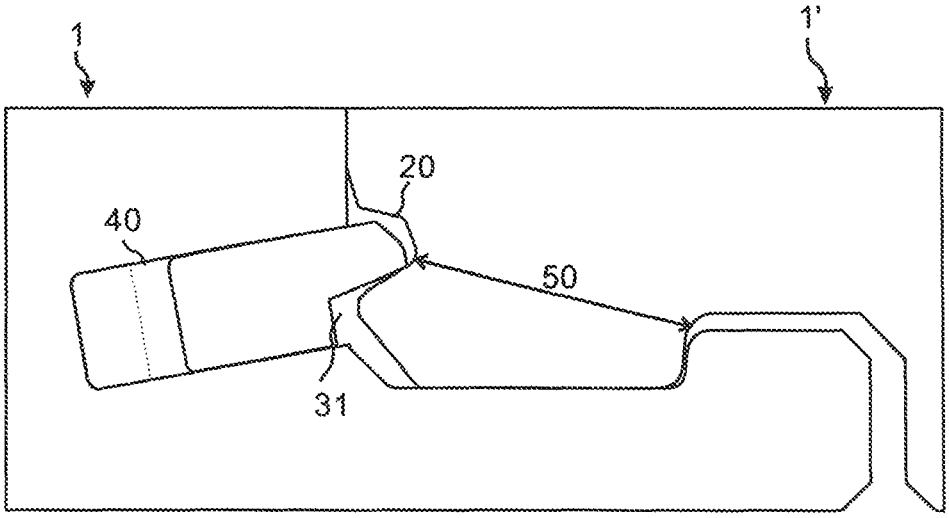

A known mechanical locking system for building panels, which comprises a displaceable tongue 30 at a first edge of a first panel 1 and a first tongue groove 20 at a second edge of a second panel 1', is shown in FIGS. 1A-B. The displaceable tongue is configured to cooperate with the first tongue groove for locking in a vertical direction. The displaceable tongue 30 is a separate part and is made of, e.g., plastic, and inserted in a displacement groove at the first edge of the first panel 1. The tongue is pushed into a displacement groove during a vertical assembling of the first and the second edge of the first and the second panel. The displaceable tongue springs back and into a first tongue groove 20 at the second edge of the second panel 1' when the panels have reached a locked position. A third and a fourth edge of the panels are provided with a locking system, which enables assembling to an adjacent panel 1" by an angling movement, to obtain a simultaneous assembling of the first and the second edges and the third and the fourth edges.

FIGS. 2A-C and 3A-B show cross sections of different embodiments of the known displaceable tongue 30 during assembling of a first and a second panel 1, 1'. The second panel 1' with the first tongue groove is displaced in relation to the second panel with the displaceable tongue 30, which is pushed into a displacement groove 40 by an edge of the second panel. The displaceable tongue 30 springs back, and into the first tongue groove 20, when the panels have reached an assembled position, and locks the first and the second panels vertically.

Embodiments of the disclosure are shown in FIGS. 4A-B, 5A-B, 6A-B, 7A-B, 8A-D, 9B-C, 10A-B, 11A-C, FIGS. 12A-B and FIGS. 13A-C. A mechanical locking system is formed at a first and a second edge of essentially identical first and second panels 1, 1'. The mechanical locking system is configured for locking the first edge of the first panel to the second edge of the second panel, in a vertical and/or horizontal direction. An embodiment of the mechanical locking system enables assembling of the first and the second panels by a vertical displacement of the second edge of the second panel relative the first edge of the first panel. The mechanical locking system is preferably formed by mechanical cutting, such as milling, drilling and/or sawing, of the edges of the panels and provided with a displaceable tongue 30, preferably of plastic. The displaceable tongue may be bendable and provided with protruding bendable parts, such as the displaceable tongues disclosed in WO2006/043893 and WO2007/015669. The displaceable tongue may also be configured to be locked by a movement along the first and the second edge, such as the displaceable tongues disclosed in WO2009/116926 and WO200/8004960.

Embodiments comprise a displaceable tongue 30 arranged in a displacement groove 40 at the first edge of the first panel 1. The displaceable tongue 30 cooperates with a first tongue groove 20, which is formed at the second edge of a second panel 1', for locking of the first and the second edge in a vertical direction. A first locking strip 6 with a vertically protruding first locking element 8 is formed in the first edge of the first panel. The first locking element 8 cooperates with a first locking groove 14, formed in the second edge of the second panel 1', for locking of the first and the second edge in a horizontal direction. A lower edge surface of the second edge may be arranged in the same plane as a first upper surface of the first locking element. The lower edge surface may be configured to cooperate with the first upper surface for locking the first and the second edge in a vertical direction. FIGS. 4A-B and FIGS. 5A-B show that the height 21 of the opening of the first tongue groove 20 is smaller than the height 41 of the displacement groove 40. Preferably, also the maximum height of the first tongue groove 20 is smaller than the maximum height 42 of the displacement groove 40. The tongue groove and the displacement groove may be provided with a guiding bevel or rounding that are not include in the height of the opening or the maximum height of the groove when measuring the heights of the grooves. Such a first tongue groove has the effect that the distance 23 between a lower side of the second panel and the bottom of the first tongue groove may be increased and the distance 50 between the first tongue groove 20 and the locking groove 14 may be increased. The increased distance 50 between the first tongue groove 20 and the locking groove 14 increases the strength of the locking system. In order to further increase the distance and the strength the displacement groove and the displaceable tongue may be angled, as is shown in, e.g., FIG. 4B and FIG. 5A-B. The outer part of the displaceable tongue is preferably provided with a recess 31, so that the outer part may be displaced into the first tongue groove 20.

Figure 5A:
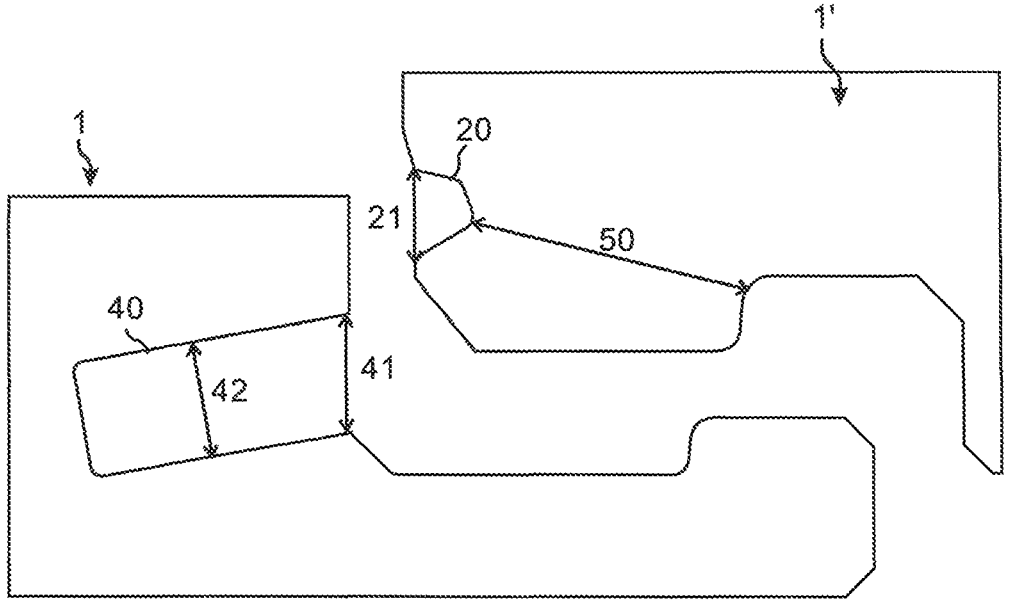
FIGS. 5A-5B show cross sections of panels according to an embodiment of the disclosure.
Figure 5B:
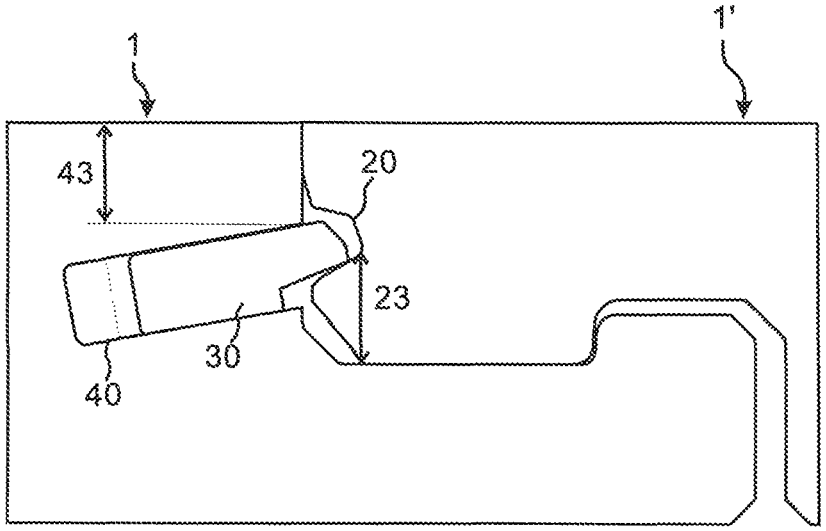

With the smaller first tongue groove 20 the distance 43 between a front face of the first panel and the displacement groove 40 may be increased and/or the thickness of the locking strip 6 may be increased with the same or increased distance 50 between the first tongue groove 20 and the locking groove 14 for the same thickness of the first and second panel, as is shown in FIG. 5B.

The first locking groove may also be arranged on the first panel with the displacement groove. Such embodiments are preferably provided with a displaceable and flexible tongue, which is fixed to parts of the displacement groove by glue. An inner part of the flexible and displaceable tongue is preferably glued to a bottom surface of the displacement groove. The inner part may also be glued to an upper and/or lower surface of the displacement groove 40.

Figure 6A:
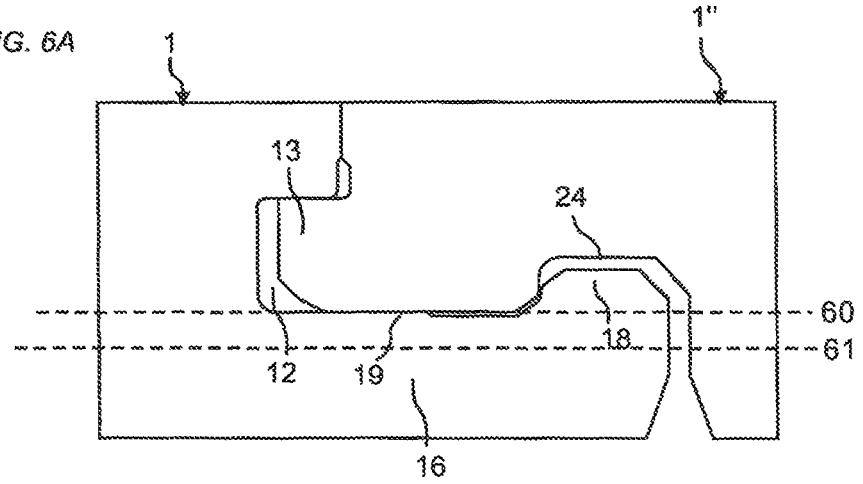
FIGS. 6A-6B show cross sections of long and short edges of panels according to an embodiment of the disclosure.
Figure 7A:
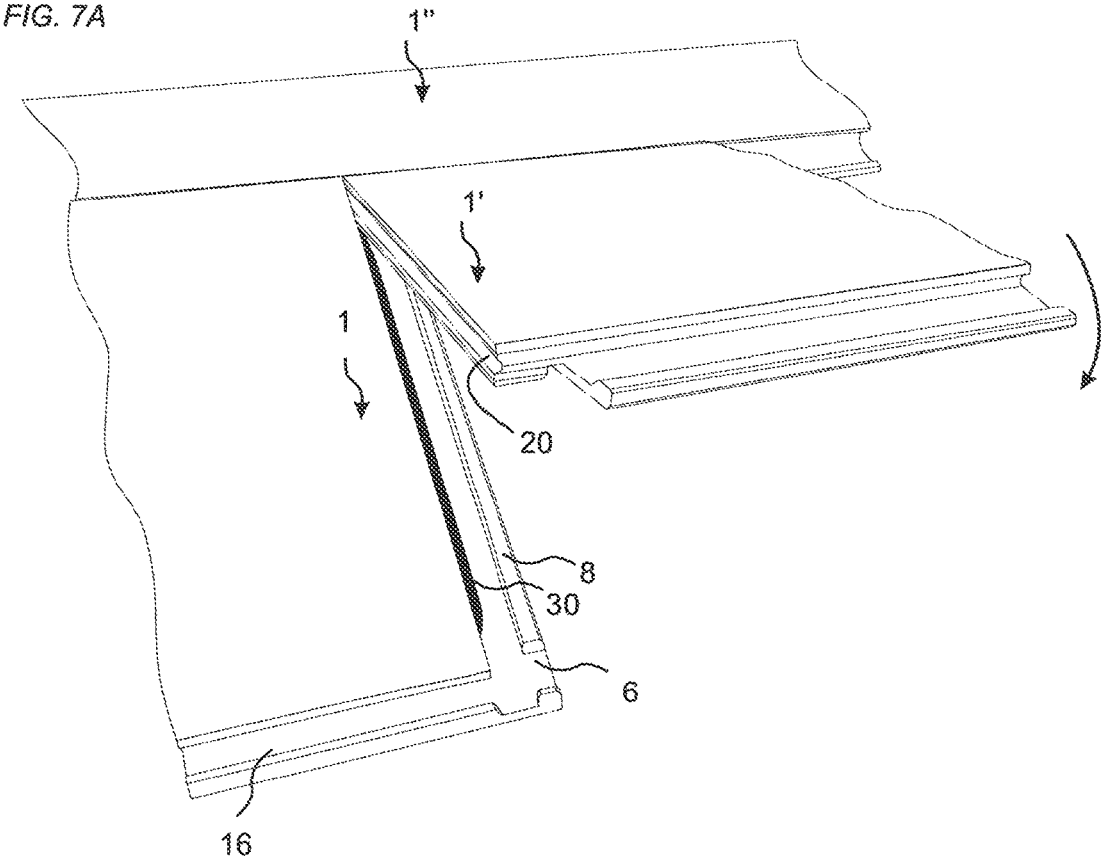
FIGS. 7A-7B show panels according to an embodiment of the disclosure.

Embodiments comprise a set of essentially identical panels comprising the first panel 1, the second panel 1' and a third panel 1", as shown in FIG. 7A. Each panel may be of a rectangular shape and the mechanical locking system may comprise a second locking strip 16, at a third edge 5*a*, provided with a second locking element 18, and a second locking groove 24 at a fourth edge 5*b*, as is shown in e.g. FIG. 6A and FIG. 7B. The second locking element 18 is configured to cooperate with the second locking groove 24 for locking of the third and the fourth edge in a horizontal direction. The mechanical locking system may comprise a second tongue groove 12 at a third edge 5*a* and a second tongue 13 at a fourth edge 5*b*. The second tongue and the second tongue groove are configured to cooperate for locking of the third and the fourth edge 5*a*, 5*b* in a horizontal direction. The fourth edge 5*b* is preferably provided with a lower edge surface configured to cooperate with a second upper surface of the second locking strip. The lower edge surface is therefore arranged in the same plane as the second upper surface of the second locking strip at the adjacent panel.

FIG. 7A shows an assembling of the second panel 1' to the first and the third panel 1, 1". The second panel 1' is angled around the fourth edge 5*b* of the second panel 1' to obtain simultaneously locking of the fourth edge 5*b* of the second panel 1' to the third edge 5*a* of the third panel 1" and the second edge 4*b* of the second panel 1' to the first edge 4*a* of the first panel 1'.

Figure 7B:
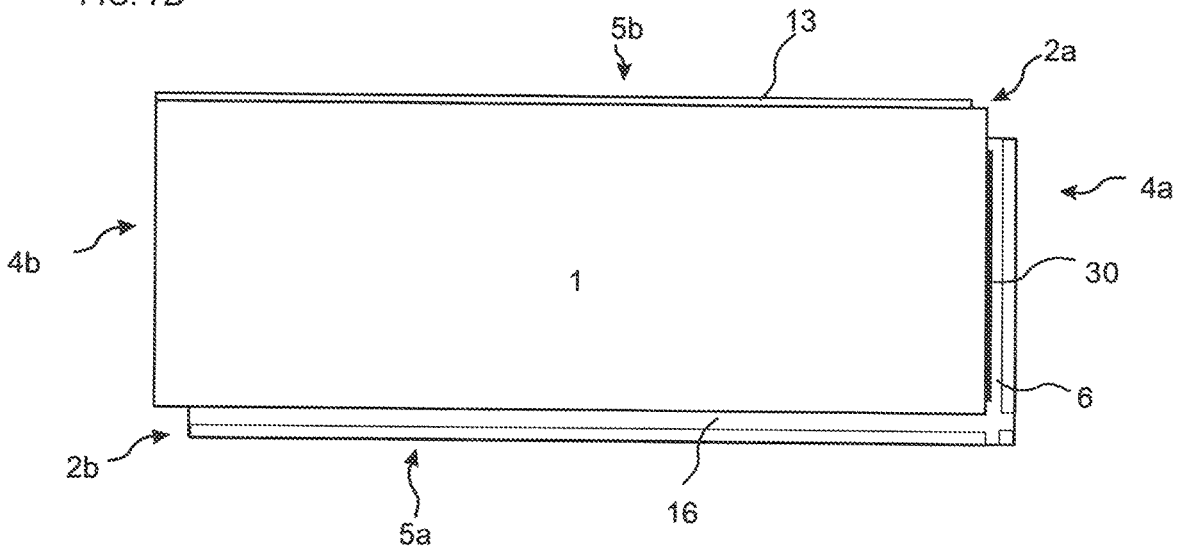

The first upper surface 9 of the first locking strip is preferably provided in a same plane as the second upper surface 19 of the second locking strip 16. The mechanical locking system at the third and the fourth edge 5*a*, 5*b* is normally produced before the mechanical locking system at the first and the second edge 4*a*, 4*b*. If said first and second upper surface are in the same plane or essentially in the same plane remainders of the mechanical locking system at the third and fourth edge 5*a*, 5*b*, at corners of the panel may be automatically removed. The remainders are generally thin and may later come loose, e.g. during packaging, transportation or assembling. An embodiment is shown in FIG. 7B with a first corner 2*a*, between the fourth edge 5*b* and the first edge 4*a*, and a second corner 2*b* between the third edge 5*a* and the second edge 4*b*. The remainder of the mechanical locking system at the fourth edge and the first corner 2*a* are automatically removed when forming the mechanical locking system at the first edge. The remainders of the mechanical locking system at the third edge and the second corner 2*b* are automatically removed when forming the mechanical locking system at the second edge.

Figure 6B:
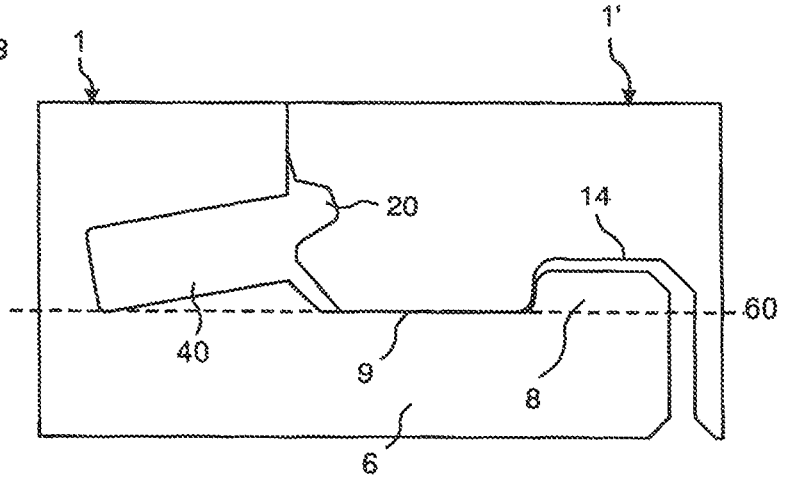

FIG. 6A shows a cross section of the third edge of the first panel 1 and the fourth edge of the third panel 1". The mechanical locking system at the third and the fourth edge comprises the second tongue 13 at the fourth edge and the second tongue groove 12 at the third edge. The third edge is provided with the second locking strip 16, protruding from the third edge, with the second locking element 18, and the fourth edge is provided with the second locking groove. The second upper surface 19 of the locking strip 16 is in contact with the lower surface of the fourth edge for locking in a vertical direction. The shown mechanical locking system at the third and the fourth edge is configured to be assembled and locked by an angling motion. The second upper surface is positioned in a horizontal plane 60. FIG. 6B shows a cross section of the first edge of the first panel and the second edge of the second panel. The first edge is provided with the first locking strip 6, protruding from the first edge, with a first locking element 8, and the second edge is provided with the first locking groove. The first upper surface 9 of the first locking strip is in contact with a lower surface of the second panel for locking in a vertical direction. The remainders of the mechanical locking system, at the third edge and the second corner and at the fourth edge and the first corner, may be automatically removed if said first and second upper surfaces are in the same horizontal plane 60. Unremoved remainders, such as the remainders 70 at the second corner shown in FIG. 1B, are generally thin and may later come loose, e.g. during packaging, transportation or assembling.

Figure 6C:
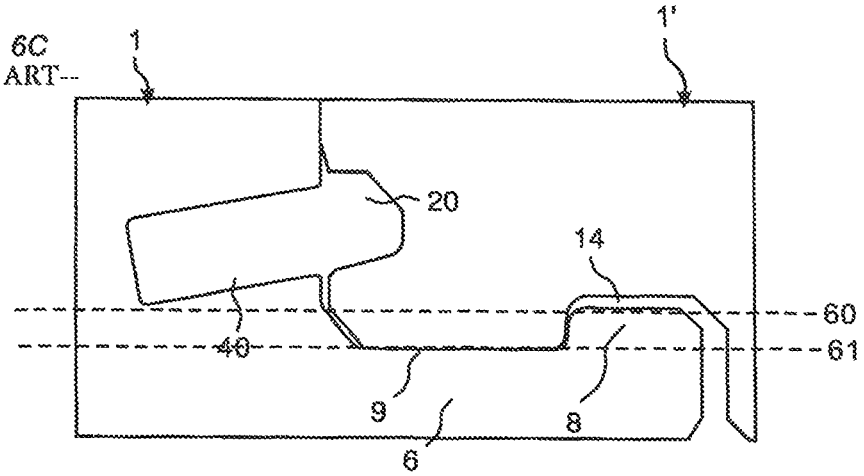
FIG. 6C shows a cross section of known panels.

The known mechanical locking system at the first and the second edges, as is shown in FIG. 6C, is provided with a first upper surface 9 at a lower horizontal plane 61 than the second upper surface at the third and the fourth edge. For the known mechanical locking system an additional operation is required to remove the remainder. The disclosure makes it possible to increase the thickness of the first locking strip and thereby arranging the first and the second upper surface in the same horizontal plane 60 without decreasing the distance 50 between the first locking groove 14 and the first tongue groove 20. This has the effect that the strength of the mechanical locking system is increased.

A preferred embodiment of the displaceable tongue 30 is shown in FIGS. 8A-D. The displaceable tongue comprises several bendable parts 33. The bendable parts are provided with a lower and an upper friction connection 35 at a distance from the innermost part of the bendable part. The innermost part of the bendable parts 33 is provided with an upper and a lower bevel 39. The tongue is of a longitudinal shape and an outer edge of the displaceable tongue is preferably straight along essentially the whole longitudinal length of the displaceable tongue. An outer part 38 of the displaceable tongue is provided with a recess 31, which preferably extends along essentially the whole longitudinal length of the tongue. A first recess surface 81 of the recess is configured to cooperate with a first surface of the first tongue groove for locking in the vertical direction. A bevel 37 is provided at each end of the longitudinal edge, at a short edge of the displaceable tongue, to facilitate assembling of the first and the second panel by an angling movement. The tongue comprises a groove 34 at each bendable part 33. At least a part of the bendable part 33 is pushed into the groove 34 during assembling. The recess 31 may comprise a second recess surface 85, which is arranged at an obtuse angle to the first recess surface 81. An angle between an upper surface of the displaceable tongue and the first recess surface 81 may be in the range of about 5° to about 15°, preferably in the range of about 7° to about 8°.

Figure 8A:
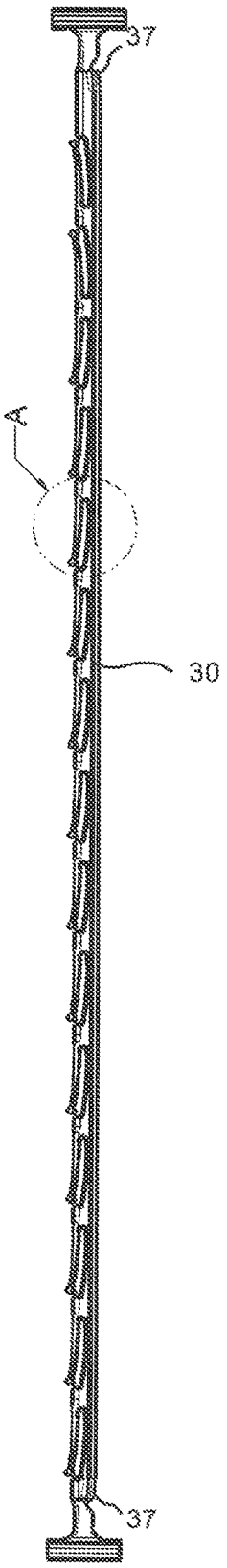
FIGS. 8A-8D show a displaceable tongue according to an embodiment of the disclosure.

The displaceable tongue is preferably produced by injection moulding and FIG. 8A shows casting gates at the short edges of the displaceable tongue.

Figure 8B:
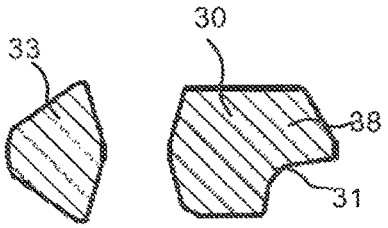
Figure 8C:
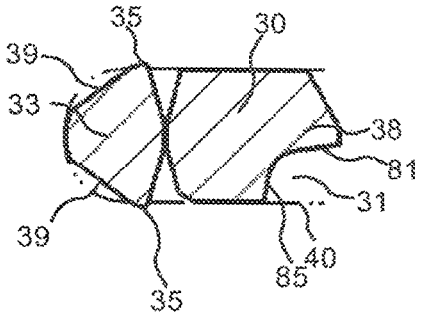
Figure 8D:
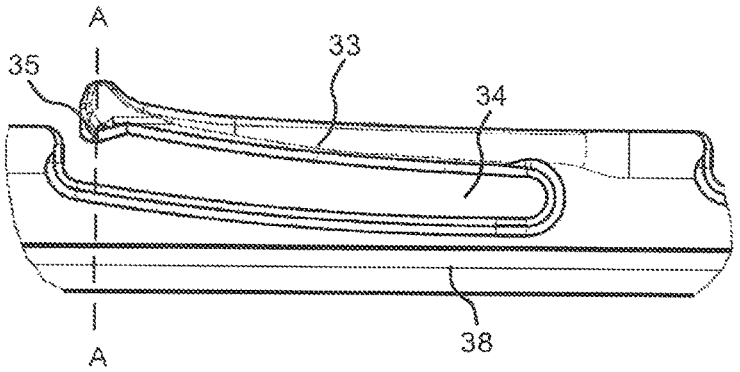

FIGS. 8B-8C are cross section views of the displaceable tongue shown in FIG. 8D, taken along line A-A in FIG. 8D (note that the relative vertical orientations of FIGS. 8B-8C are flipped). FIG. 8C shows displaceable tongue 30 arranged in the displacement groove 40 in a position during an assembling when the tongue is pushed into the displacement groove. The displacement groove 40 comprises an upper wall, a lower wall and an inner wall extending between the lower and the upper wall. The inner wall is of a rounded shape. The inner wall may as an alternative comprise a plane section provided with a round section adjacent to the upper and/or lower wall. The upper friction connection is configured to cooperate with a plane section of the upper wall. The lower friction connection is configured to cooperate with a plane section of the lower wall. An upper surface of the displaceable tongue may be configured to be displaced along the upper wall during assembling of the first and the second panel. A lower surface of the displaceable tongue may be configured to be displaced along the lower wall during assembling of the first and the second panel.

Figure 9A:
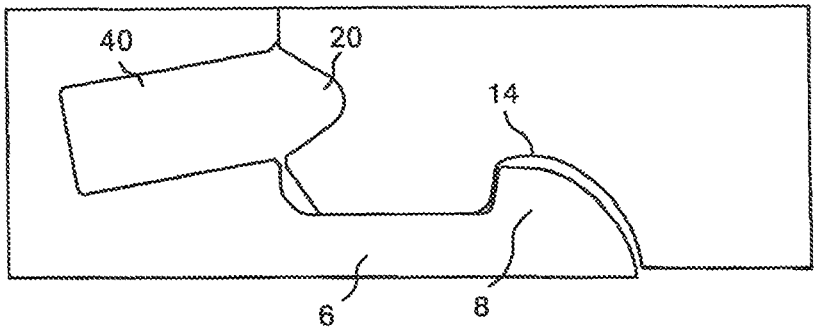
FIG. 9A shows a cross section of known panels.
Figure 9B:
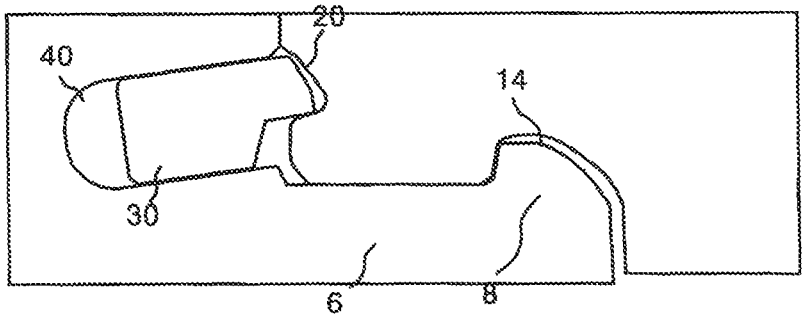
FIGS. 9B-9C show cross sections of embodiments of the disclosure.
Figure 9C:
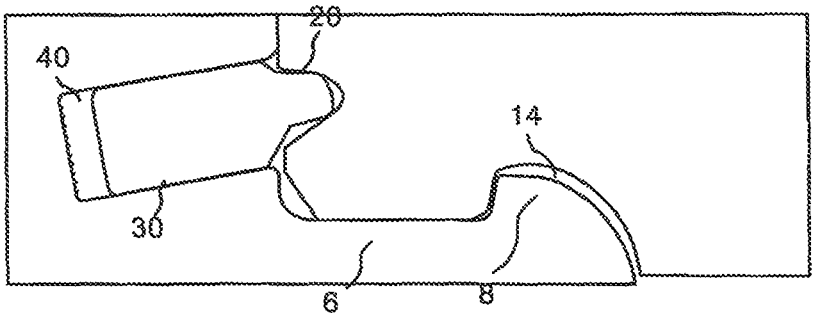

FIG. 9A shows another known mechanical locking system and FIG. 9B-C shows an improved version according to embodiments of the disclosure. The displaceable tongue 30 is provided with a recess at the outer part and the first tongue groove 20 is made smaller. The thickness of the locking strip 6 is increased and a bottom of the displacement groove 40 is provided with rounded corners. FIG. 9C shows that the upper and the lower outer part of the displaceable tongue may be provided with a recess. Particularly for floorboards of soft material, e.g. comprising a plastic core such as PVC, the joint is made stronger if both the upper and the lower outer part of the displaceable tongue are in contact with first tongue groove.

Figure 10A:
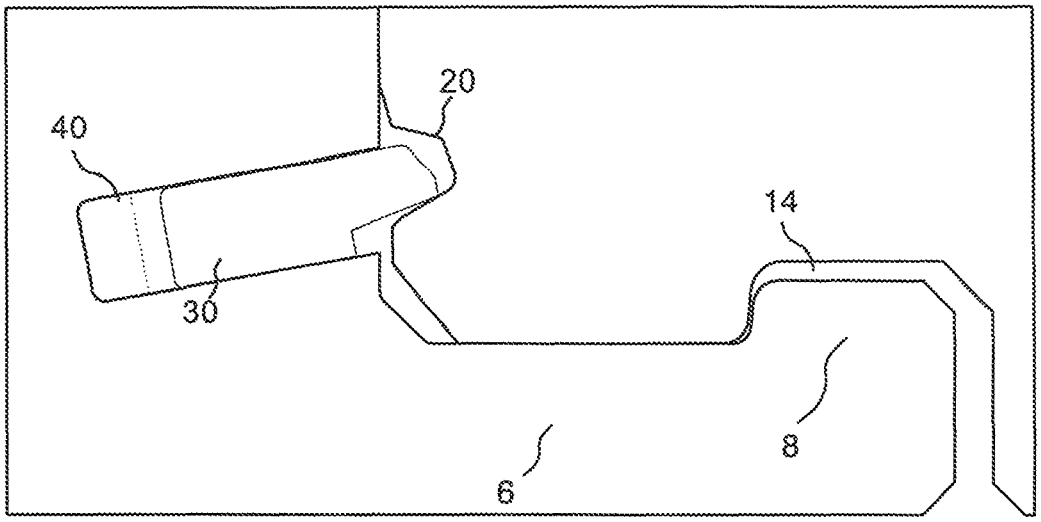
FIGS. 10A-10B show cross sections of embodiments of the disclosure.
Figure 10B:
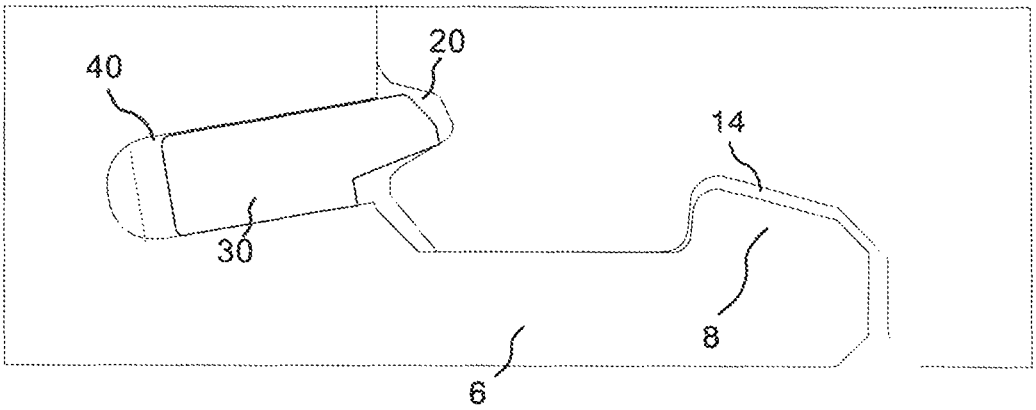

Further embodiments of the disclosure are shown in FIGS. 10A-B. The benefits of the smaller first tongue groove 20 and the displaceable tongue 30 provided with a recess at the outer part are in the embodiment in FIG. 10A utilized to make the locking strip 6 thicker. FIG. 10B shows an embodiment with a displacement groove 40 provided with rounded corners and a locking groove 14 and locking element 8 provided with chamfered surfaces in order to further increase the strength of the locking system.

Figure 11A:
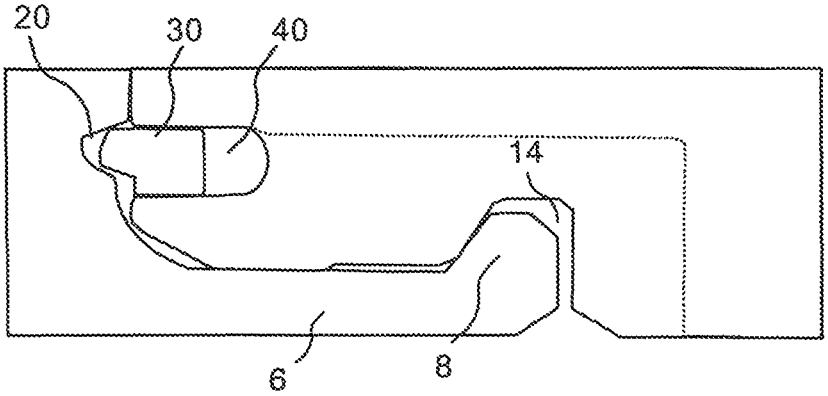
FIGS. 11A-11C show cross sections of embodiments of the disclosure.

FIG. 11A shows an embodiment which is of the type disclosed in WO2011/127981 with the displaceable tongue 30 arranged at the edge of the panel provided with the locking groove. The recess at the outer edge of the displaceable tongue is shown on the lower edge of the displaceable tongue but the recess may also be provided at the upper and outer edge of the displaceable tongue.

Figure 11B:
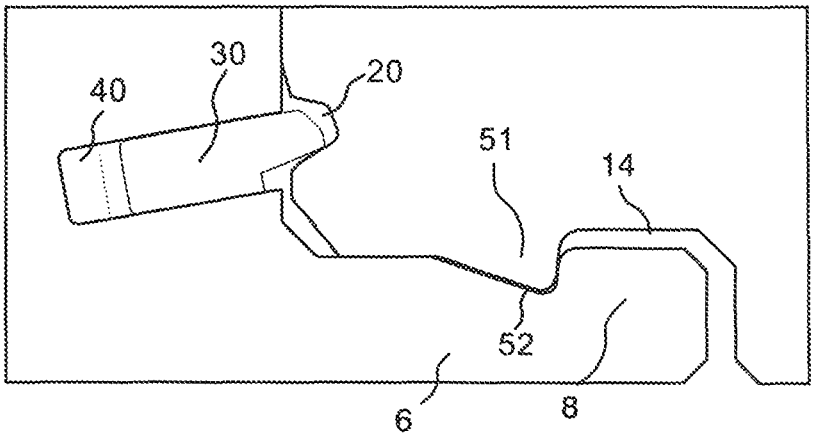
Figure 11C:
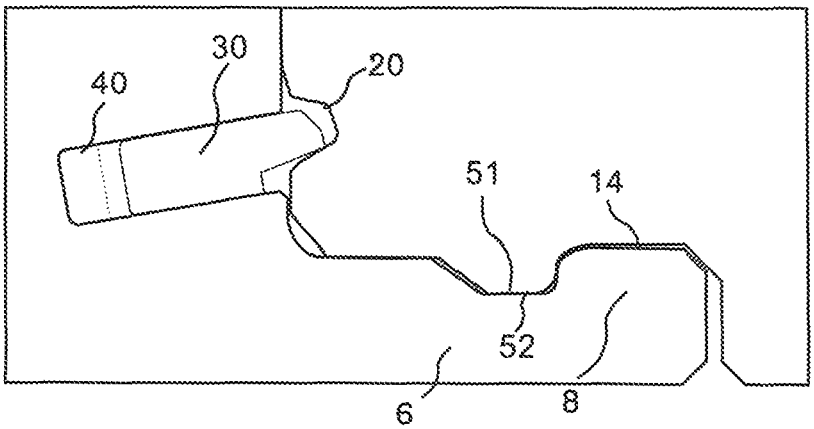

FIGS. 11B-C shows embodiments provided with a protruding part 51 at the lower side of the second edge. The protruding part 51 is configured to cooperate with a recess 52 at the upper side of the first locking strip and with the first locking element 8. Such configurations may increase the thickness of an inner part of the locking strip and the strength of the mechanical locking system.

Figure 12A:
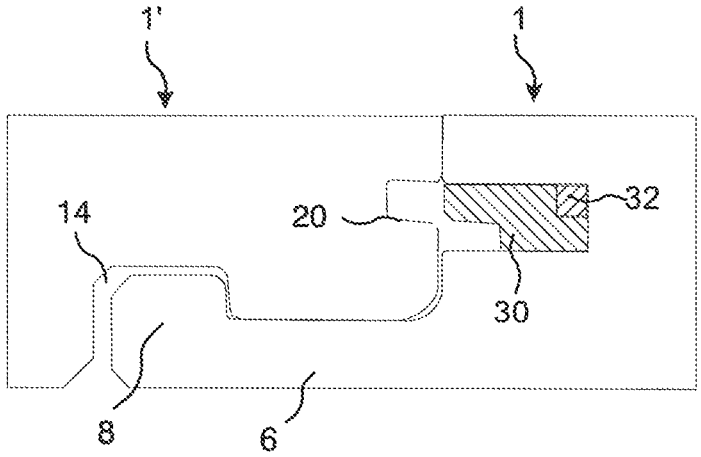
FIGS. 12A-12B show cross sections of an embodiment of the disclosure.
Figure 12B:
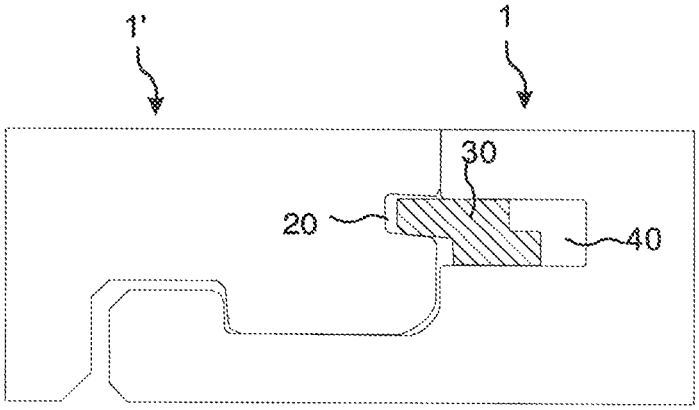

FIGS. 12A-B shows an embodiment comprising a displaceable tongue 30, which is configured to be locked by a displaceable element 31. The displaceable element may comprise a wedge shaped element (not shown) that pushes the displaceable tongue 30 into the first tongue groove 20 for vertical locking of the first and the second edge. The displaceable element may be displaced by pushing the displaceable element into 32 the displacement groove 40 along the second edge or by pulling the displaceable element along the second edge and out of the displacement groove 40. FIG. 12A shows the embodiment in and unlocked position and FIG. 12B shows the embodiment in a locked position.

Figure 13A:
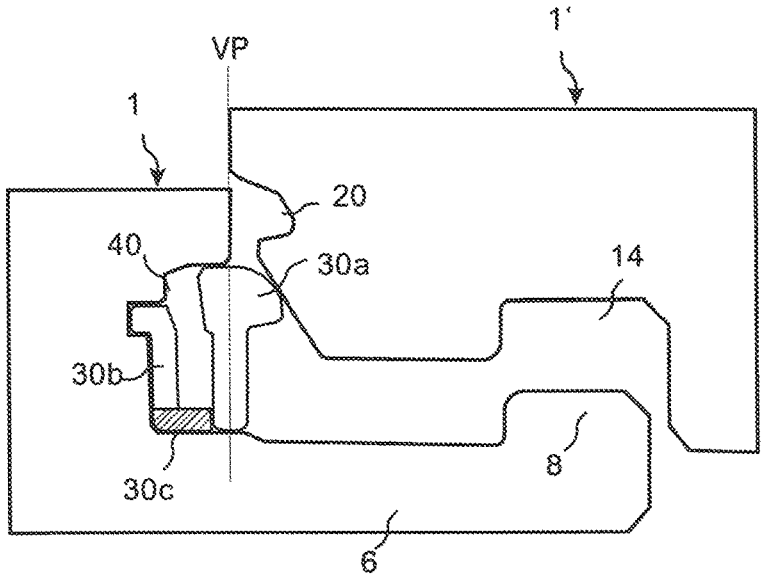
FIGS. 13A-13C show cross sections of an embodiment of the disclosure.
Figure 13B:
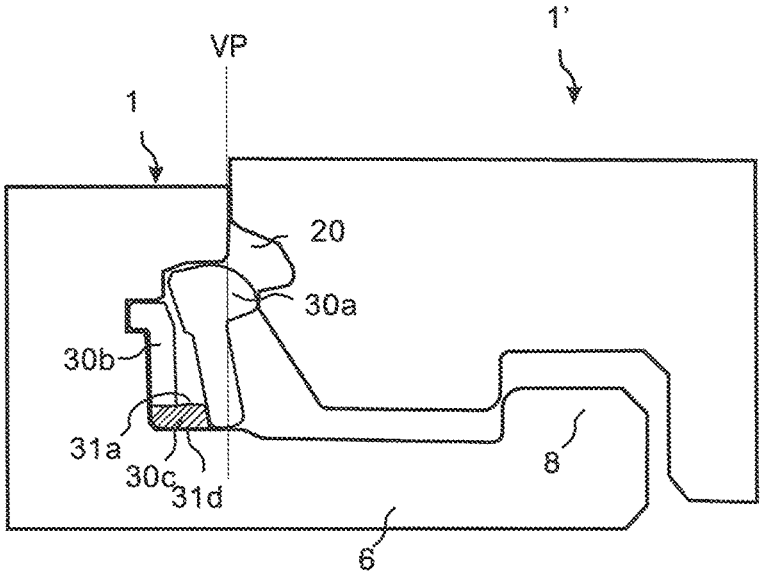
Figure 13C:
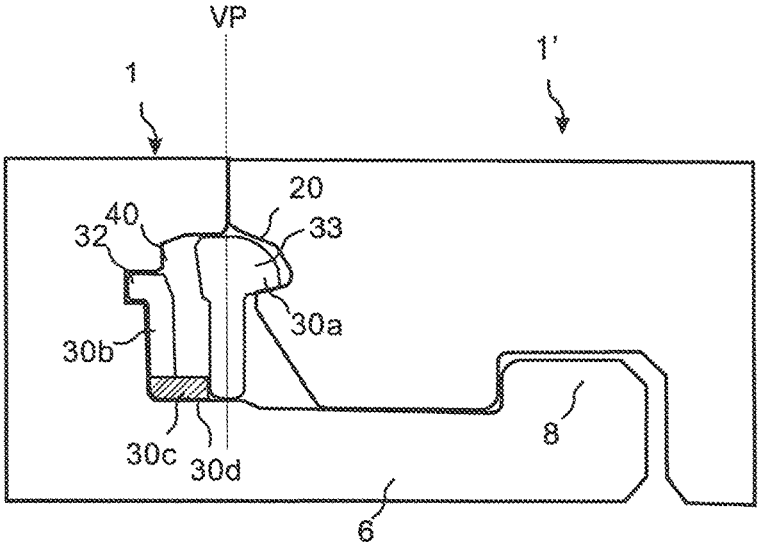

FIGS. 13A-C shows a displaceable tongue comprising three sections, an inner section 30*b*, an outer section 30*a* and a middle section 30*c* connected to each other. The sections are preferably formed from a plastic material. The outer and inner sections 30*a* and 30*b* are formed from a more rigid material than the middle section that provides the major flexibility to the flexible tongue. The middle section may be a rubber like material and may also be used as a friction connection in order to prevent that the flexible tongue falls out from the groove 40 after connection to a panel edge. The flexible middle section 30*c* is preferably located at a lower part of the flexible tongue. The middle section 30*c* comprises an upper part 31*a* that is compressed during locking and a lower part 31*b* that expands during locking. The outer part 30*a* protrudes preferably outside a vertical pane VP that intersects the upper adjacent joint edges of the panels 1, 1'. The locking system allows locking with low horizontal separation forces during locking. The vertical extension of the tongue groove 20 may be less than 0.5 times the vertical extension of the displacement groove 40. The inner part 30*b* comprises a fixing edge 32 that may be located at an upper or a lower part of the flexible tongue.

The flexible tongue may also be formed with only two sections, preferably without the more rigid inner section 30*b*. An outer section 30*a* may be connected to an inner section 30*d* that may have the same function as the above described middle section 30*c* and flexibility may be obtained with compression and extension of upper and lower parts of the flexible inner section when the outer section is turning inwards. This allows that the displacement groove may be smaller. Such a two sections tongue may also be used to lock panel according to the principles shown in FIGS. 2A-C. The outer part 30*a* may point downwards when the flexible tongue 30 is located on a panel edge comprising a strip 6 (strip panel) and a locking element 8 and the flexible inner part 31*d* may be locate at an upper part of the flexible tongue 30. The outer part 30*a* may point upwards when the flexible tongue 30 is connected to a panel edge comprising a locking groove (fold panel) and the flexible inner part 30*d* may be located at a lower part of the flexible tongue 30.

Figure 14A:
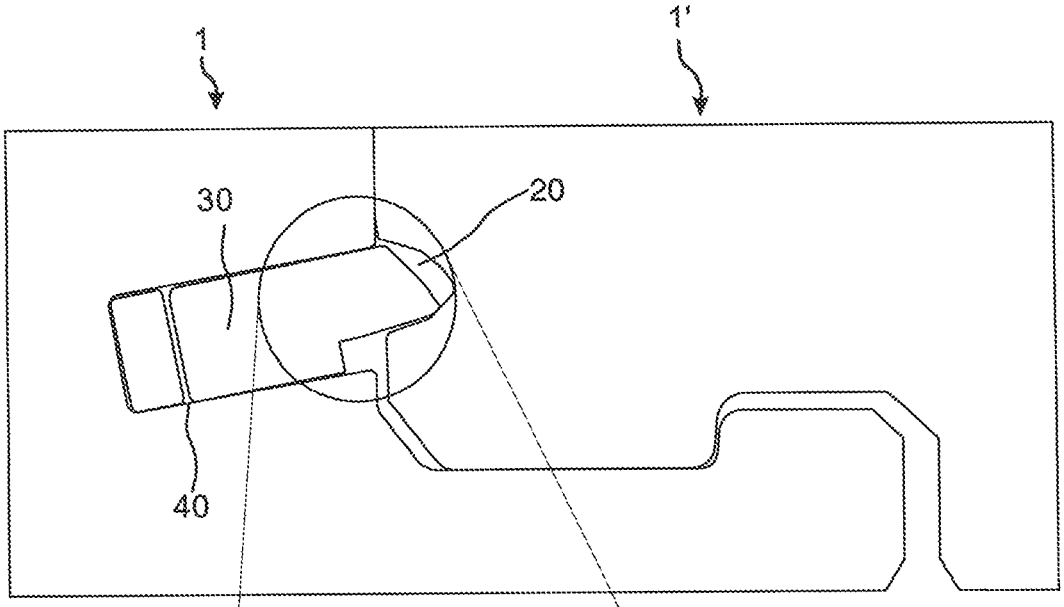
FIGS. 14A-14B show a cross section of an embodiment of the disclosure.
Figure 14B:
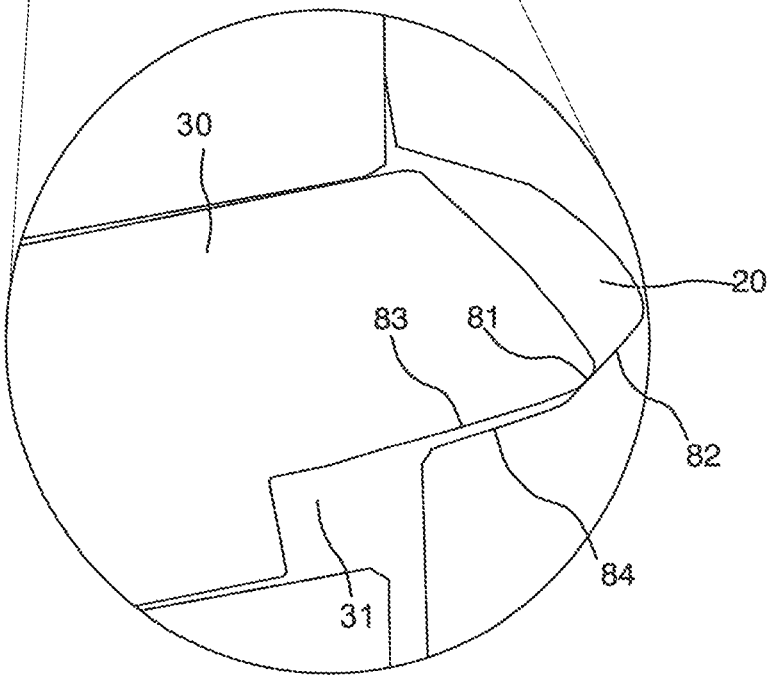

An embodiment of a mechanical locking system is shown in FIG. 14A and FIG. 14B shows an enlargement of the encircled are in FIG. 14B. The mechanical locking system comprises a displaceable tongue 30, which is arranged in a displacement groove 40 at a first edge of a first panel 1 and a first tongue groove 20 at a second edge of a second panel 1'. The displaceable tongue 30 is configured to cooperate with the first tongue groove, for locking in a vertical direction of the first and the second edge. At least a part of the displaceable tongue is preferably configured to be pushed into the displacement groove during assembling of the first and the second panel and spring back to a position in which a part of the displaceable tongue 30 cooperate with the first tongue groove 20 for the locking in the vertical direction. The displaceable tongue 30 comprises a first and a third surface 81,83 and the first tongue groove comprises a second and fourth surface 82,84. A first angle between the second surface 82 and a front face of the second panel 1' is greater than a second angle between the fourth surface 84 and the front face. The first surface of the displaceable tongue is configured to cooperate with the second surface of the tongue groove under a first load on the mechanical locking system. The third surface of the displaceable tongue is configured to cooperate with the fourth surface of the tongue groove under a second load on the mechanical locking system. The first load correspond to a load under normal condition and the second load correspond to an increased load when, for example, a chair, a sofa or a bookcase is positioned on the first or the second panel. The first angle may have the advantage that a small displacement of the displaceable tongue pushes the first and the second panel together to the desired locked position, in which the front face of the second panel 1' is essentially in the same vertical position as a front face of the first panel 1. The second angle may have the advantage that the third and the fourth surface are able to carry a greater load and that the displaceable tongue is prevented from being pushed out from the first tongue groove. The first angle may be in the range of about 30° to about 45° and the second angle may be in the range of about 10° to about 25°. The difference between the first angle and the second angle may be in the range of about 10° to about 35°. An outer part of the displaceable tongue 30 is preferably provided with the recess 31 described above and the tongue groove is preferably smaller in height and depth than the displacement groove.

The invention claimed is:

1. A set of panels provided with a mechanical locking system comprising:

a displaceable tongue, which is arranged in a displacement groove at a first edge of a first panel, and which is integrally formed and unitary such that all outer boundaries of the displaceable tongue consist of outer surfaces of the displaceable tongue, a vertical height of an innermost portion of the displacement groove being a minimum vertical height of the displacement groove, and a tongue groove at a second edge of an adjacent second panel, the displaceable tongue being configured to cooperate with the tongue groove for locking of the first edge and the second edge in a vertical direction, wherein the displacement groove comprises a displacement groove opening and the tongue groove comprises a tongue groove opening, wherein at least a part of the displaceable tongue is configured to be pushed into the displacement groove during assembling of the first panel and the second panel and spring back to a position in which an outer part of the displaceable tongue cooperates with the tongue groove for the locking in the vertical direction, wherein an upper surface of the displaceable tongue is configured to be displaced along and in contact with an upper wall of the displacement groove during assembling of the first panel and the second panel, wherein a lower surface of the displaceable tongue is configured to be displaced along and in contact with a lower wall of the displacement groove during assembling of the first panel and the second panel, wherein the displacement groove opening and the tongue groove opening are horizontally open and a vertical height of the displacement groove opening is greater than a vertical height of the tongue groove opening, the vertical height of the displacement groove opening being measured from a portion of the lower wall of the displacement groove along which and in contact with which the lower surface of the displaceable tongue is configured to be displaced during assembly of the first and second panels, and wherein an outer part of the displaceable tongue is provided with a recess which extends along essentially the whole longitudinal length of the displaceable tongue.

2. The set as claimed in claim 1, wherein the maximum height of the displacement groove is greater than the maximum height of the tongue groove.

3. The set as claimed in claim 1, wherein the thickness of the panels is in the range of about 3 mm to about 10 mm.

4. The set as claimed in claim 1, wherein the mechanical locking system comprises a first locking strip, at the first or the second edge, provided with a first locking element configured to cooperate for horizontal locking with a first locking groove at the other of the first or second edge.

5. The set as claimed in claim 4, wherein the first locking strip is arranged at the first edge, and an outer and lower part of the displaceable tongue is provided with the recess.

6. The set as claimed in claim 4, wherein the panels are rectangular and the mechanical locking system comprises a second locking strip, at a third or fourth edge, provided with a second locking element configured to cooperate for horizontal locking with a second locking groove at the other of the third or fourth edge of an adjacent third panel.

7. The set as claimed in claim 6, wherein a first upper surface of the first locking strip is arranged in a same plane as a second upper surface of the second locking strip.

8. The set as claimed in claim 6, wherein the mechanical locking system at the third and the fourth edge is configured to be assembled by an angling motion.

9. The set as claimed in claim 1, wherein the mechanical locking system at the first and the second edge is configured to be assembled by a vertical motion.

10. The set as claimed in claim 1, wherein the panels are floorboards comprising a wood fibre based core or a core comprising thermoplastic.

11. The set as claimed in claim 1, wherein the displaceable tongue is arranged in the displacement groove so that the displaceable tongue slides along a lower surface of the displacement groove in a direction toward and away from the adjacent second panel during locking.

12. The set as claimed in claim 1, wherein the first tongue groove extends vertically higher than does the displacement groove.

13. The set as claimed in claim 1, wherein the displaceable tongue comprises at least two bendable parts.

14. The set as claimed in claim 13, wherein the displaceable tongue comprises a groove at each bendable part.

15. The set as claimed in claim 14, wherein at least a part the bendable part is pushed into the groove during assembling.

16. The set as claimed in claim 1, wherein the panels are furniture components.

17. A set of panels provided with a mechanical locking system comprising:

a displaceable tongue, which is arranged in a displacement groove at a first edge of a first panel, and which is integrally formed and unitary such that all outer boundaries of the displaceable tongue consist of outer surfaces of the displaceable tongue, and a tongue groove at a second edge of an adjacent second panel, the displaceable tongue being configured to cooperate with the tongue groove for locking of the first and second edges in a vertical direction, wherein the displacement groove comprises a displacement groove opening and the tongue groove comprises a tongue groove opening, wherein at least a part of the displaceable tongue is configured to be pushed into the displacement groove during assembling of the first and second panels and spring back to a position in which an outer part of the displaceable tongue cooperate with the first tongue groove for the locking in the vertical direction, wherein an upper surface of the displaceable tongue is configured to be displaced along an upper wall of the displacement groove during assembling of the first and second panels, wherein a lower surface of the displaceable tongue is configured to be displaced along a lower wall of the displacement groove during assembling of the first and second panels, wherein the displacement groove opening and the tongue groove opening are horizontally open and the vertical height of the displacement groove opening is greater than a vertical height of the tongue groove opening, wherein an outer part of the displaceable tongue is provided with a recess which extends along essentially the whole longitudinal length of the displaceable tongue, and wherein the recess comprises a first recess surface and a second recess surface, which are arranged at an obtuse angle to each other.

18. The set as claimed in claim 17, wherein the first recess surface of the recess is configured to cooperate with the tongue groove for locking in the vertical direction.

19. The set as claimed in claim 17, wherein an angle between an upper surface of the displaceable tongue and the first recess surface is in the range of about 5° to about 15°.

20. A set of panels provided with a mechanical locking system comprising:

a displaceable tongue, which is arranged in a displacement groove at a first edge of a first panel, and which is integrally formed and unitary such that all outer boundaries of the displaceable tongue consist of outer surfaces of the displaceable tongue, and a tongue groove at a second edge of an adjacent second panel, the displaceable tongue being configured to cooperate with the tongue groove for locking of the first edge and the second edge in a vertical direction, a vertical height of an innermost portion of the tongue groove being smaller than a vertical height of an innermost portion of the displacement groove, the vertical height of the innermost portion of the displacement groove being a minimum vertical height of the displacement groove, wherein the displacement groove comprises a displacement groove opening and the tongue groove comprises a tongue groove opening, wherein at least a part of the displaceable tongue is configured to be pushed into the displacement groove during assembling of the first panel and the second panel and spring back to a position in which an outer part of the displaceable tongue cooperates with the tongue groove for the locking in the vertical direction, wherein an upper surface of the displaceable tongue is configured to be displaced along an upper wall of the displacement groove during assembling of the first panel and the second panel, wherein a lower surface of the displaceable tongue is configured to be displaced along a lower wall of the displacement groove during assembling of the first panel and the second panel, wherein the displacement groove opening and the tongue groove opening are horizontally open and the vertical height of the displacement groove opening is greater than a vertical height of the tongue groove opening, and wherein an outer part of the displaceable tongue is provided with a recess which extends along essentially the whole longitudinal length of the displaceable tongue.

* * * * *